US007672611B2

(12) United States Patent
Nakaya

(10) Patent No.: US 7,672,611 B2
(45) Date of Patent: Mar. 2, 2010

(54) DEVELOPER CARTRIDGE AND IMAGE FORMING APPARATUS

(75) Inventor: Yukiko Nakaya, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 847 days.

(21) Appl. No.: 11/341,500

(22) Filed: Jan. 30, 2006

(65) Prior Publication Data

US 2006/0171739 A1 Aug. 3, 2006

(30) Foreign Application Priority Data

Jan. 31, 2005 (JP) ..... 2005-023227

(51) Int. Cl.
*G03G 15/04* (2006.01)

(52) U.S. Cl. ..... 399/119

(58) Field of Classification Search ..... 399/119, 399/222, 111, 113, 252, 265
See application file for complete search history.

(56) References Cited

U.S. PATENT DOCUMENTS

| | | | | |
|---|---|---|---|---|
| 5,634,178 | A | 5/1997 | Sugiura et al. | |
| 5,729,795 | A | 3/1998 | Kavolius et al. | |
| 5,920,753 | A * | 7/1999 | Sasaki et al. | 399/111 |
| 6,118,960 | A * | 9/2000 | Nakagawa et al. | 399/111 |
| 6,349,189 | B1 * | 2/2002 | Jeon | 399/119 |
| 6,763,210 | B2 * | 7/2004 | Sato et al. | 399/109 |
| 6,823,160 | B2 | 11/2004 | Okabe | |
| 7,024,137 | B2 * | 4/2006 | Nittani et al. | 399/222 |
| 7,027,756 | B2 * | 4/2006 | Hoshi et al. | 399/111 |
| 2004/0131382 | A1 | 7/2004 | Kikuchi et al. | |
| 2005/0063735 | A1 | 3/2005 | Okabe | |

FOREIGN PATENT DOCUMENTS

| | | | |
|---|---|---|---|
| EP | 0 626 624 | A2 | 11/1994 |
| EP | 0 843 238 | A2 | 5/1998 |
| JP | A-09-222759 | | 8/1987 |
| JP | 03230173 | A * | 10/1991 |
| JP | A-06-314001 | | 11/1994 |
| JP | A-07-072672 | | 3/1995 |
| JP | A-09-311517 | | 12/1997 |
| JP | A-11-316478 | | 11/1999 |
| JP | A-2003-295614 | | 10/2003 |
| JP | A-2004-021055 | | 1/2004 |
| JP | A-2004-100923 | | 4/2004 |

* cited by examiner

*Primary Examiner*—Robert Beatty
(74) *Attorney, Agent, or Firm*—Oliff & Berridge, PLC

(57) ABSTRACT

A developer cartridge includes a casing, a development roller, a support member, and at least one transmission gear. The development roller is rotatably disposed in the casing. The support member is provided as a separate member from the casing and is mounted on the casing. The at least one transmission gear is rotatably supported by the support member. The at least one transmission gear transmits a driving force to the development roller. The support member is configured to be dismounted from the casing together with the at least one transmission gear.

14 Claims, 24 Drawing Sheets

DEVELOPER CARTRIDGE AND IMAGE FORMING APPARATUS

CROSS REFERENCE TO RELATED APPLICATIONS

This application claims priority from Japanese Patent Application No. P2005-023227, filed Jan. 31, 2005. The entire content the priority application is incorporated herein by reference.

TECHNICAL FIELD

The disclosure relates to a developer cartridge and an image forming apparatus.

BACKGROUND

Image forming apparatuses such as laser printers have a developer cartridge that generally includes a housing, an agitator, a development roller and a supply roller, which are rotatably disposed in the housing. The agitator agitates toner. The development roller is configured to bear toner on its surface. The supply roller supplies toner to the development roller. The development roller of the developer cartridge is disposed to confront a photosensitive drum. The toner borne on the development roller is transferred to the electrostatic latent image formed on the photosensitive drum. The latent image is thereby developed.

As disclosed in U.S. Pat. No. 6,823,160 (corresponding to Japanese Patent Application Publication No. 2003-295614), the shaft of the development roller protrudes outside from the housing of the developer cartridge. A fixed gear is mounted on the part of the shaft that protrudes from the housing. The fixed gear therefore rotates when the development roller is rotated. The fixed gear is engaged with a plurality of gears, which are held in a protection cover and prevented from coming out of engagement. These gears transmit a driving force from the main body of the image forming apparatus that includes developer cartridge. Thus, the development roller is rotated.

SUMMARY

The development roller may be removed (dismounted) from the developer cartridge, for recycle use. To remove the development roller, the gears mentioned above must be removed, too. In this case, the protection cover should be removed first, and the gears should then be removed from the cover, one by one. This is a cumbersome work.

In view of the foregoing, it is an object of the invention to provide a developer cartridge from which gears can be dismounted at high efficiency and an image forming apparatus that includes such a developer cartridge.

In order to attain the above and other objects, according to one aspect, the invention provides a developer cartridge. The developer cartridge includes a casing, a development roller, a support member, and at least one transmission gear. The development roller is rotatably disposed in the casing. The support member is provided as a separate member from the casing and is mounted on the casing. The at least one transmission gear is rotatably supported by the support member. The at least one transmission gear transmits a driving force to the development roller. The support member is configured to be dismounted from the casing together with the at least one transmission gear.

According to another aspect, the invention provides an image forming apparatus. The image forming apparatus includes an apparatus main body, a motor, and a developer cartridge. The motor is disposed in the apparatus main body and generates a driving force. The developer cartridge is disposed in the apparatus main body. The developer cartridge includes a casing, a development roller, a support member, and at least one transmission gear. The development roller is rotatably disposed in the casing. The support member is provided as a separate member from the casing and is mounted on the casing. The at least one transmission gear is rotatably supported by the support member. The at least one transmission gear transmits the driving force to the development roller. The support member is configured to be dismounted from the casing together with the at least one transmission gear.

BRIEF DESCRIPTION OF THE DRAWINGS

Illustrative aspects in accordance with the invention will be described in detail with reference to the following figures wherein.

DETAILED DESCRIPTION

A developer cartridge and an image forming apparatus according to illustrative aspects of the invention will be described with reference to FIGS. 1 to 12.

In the following description, the expressions "front", "rear", "upper", "lower", "right", and "left" are used to define the various parts when the image forming apparatus is disposed in an orientation in which it is intended to be used.

1. Configuration of the Image Forming Apparatus

Figure 1:
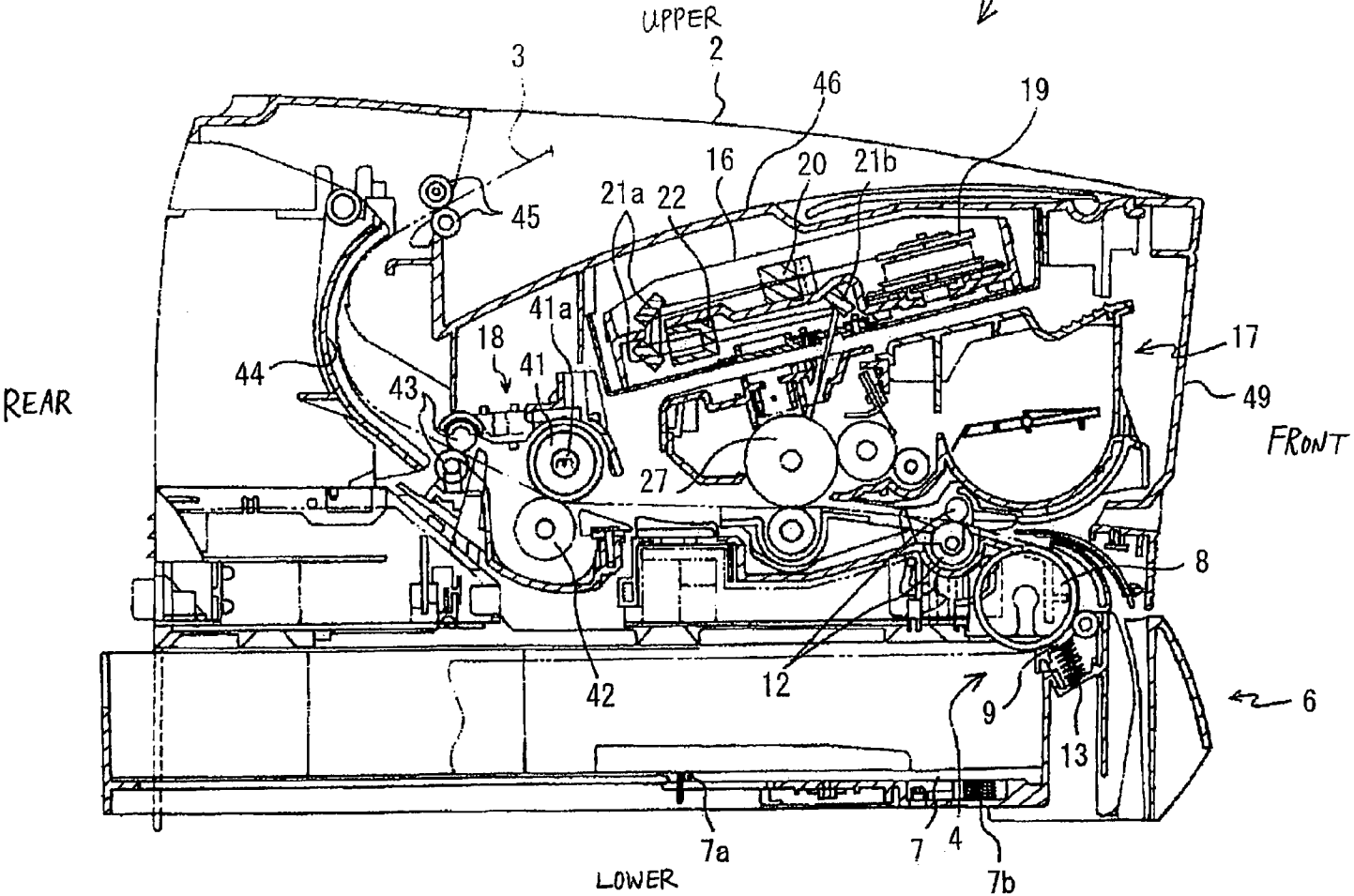
FIG. 1 is a vertical cross-sectional view of a laser printer according to illustrative aspects of the invention.

As shown in FIG. 1, the laser printer 1 has a main case 2, a feeder unit 4, a scanner unit 16, a process cartridge 17 and a fixing unit 18, which are provided in the main case 2. The feeder unit 4 feeds paper sheets 3. The scanner unit 16, the process cartridge 17, and the fixing unit 18 serve as an image-forming unit that prints images on any paper sheet supplied. In FIG. 1, the front of the laser printer 1 is shown on the right-hand side.

A sheet discharge tray 46 is provided on the front-half top of the main case 2. The sheet discharge tray 46 defines a recess that has a bottom gradually less inclined toward the front of the main case 2. The main case 2 has a partly opened space in the upper-front part, for holding the process cartridge 17. The process cartridge 17 can be inserted into and removed from this space, rotating downward and opening a cover 49 that is provided at the front of the main case 2.

The fixing unit 18 is provided in the lower-rear part (left side in FIG. 1) of the main case 2. A sheet discharge path 44 runs along the rear of the main case 2, forming an arcuate passage that guides any paper sheet from the fixing unit 18 to the sheet discharge tray 46. A pair of sheet discharge rollers 45 is provided on the sheet discharge path 44, for feeding paper sheets 3 onto the sheet discharge tray 46.

The feeder unit 4 has a sheet feed roller 8, a sheet feed cassette 6, a sheet press plate 7, a separation pad 9, and a pair of registration rollers 12. The sheet feed roller 8 is provided at the bottom of the main case 2. The sheet feed cassette 6 is set in the main case 2 and can be pulled from the front of the laser printer 1. The sheet press plate 7 is provided in the sheet feed cassette 6, holding a stack of paper sheets 3 and pressing the uppermost sheet 3 to the sheet feed roller 8. The separation pad 9 is located above one end of the sheet feed cassette 6, pressed to the sheet feed roller 8 and cooperates with the sheet feed roller 8 to separate one sheet 3 from another. The registration rollers 12 are positioned downstream of the sheet feed roller 8 and adjust the timing of feeing each paper sheet 3 that is to be printed.

The sheet press plate 7 can hold a stack of paper sheets 3. The plate 7 has a support shaft 7*a* supported at the bottom of the sheet feed cassette 6 and located remote from the sheet feed roller 8. Around the support shaft 7*a*, that part of the plate 7 which is near the sheet feed cassette 6 can rotate up and down. A spring 7*b* is provided below the sheet press plate 7, urging upwards that part of the plate 7 which is near the sheet feed cassette 6. The sheet press plate 7 is pivotally moved downward against an urging force of the spring 7*b* around the support shaft 7*a* (i.e., fulcrum) as more and more paper sheets 3 are stacked in the sheet feed cassette 6. The sheet feed roller 8 and the separation pad 9 are disposed to confront each other. A spring 13 is provided below at the rear of the separation pad 9, urging the separation pad 9 toward the sheet feed roller 8.

The registration rollers 12 perform registration of a paper sheet 3. The registration rollers 12 supply the sheet 3 when the leading edge of the sheet 3 is aligned with the leading edge of a visible image formed on the surface of the photosensitive drum 27.

The scanner unit 16 is disposed in the main case 2, right below the sheet discharge tray 46. The unit 16 includes a laser light emission section (not shown), a polygon mirror 19, an fθ lens 20, reflection mirrors 21*a* and 21*b*, and a relay lens 22. The laser light emission section emits a laser beam. The polygon mirror 19 rotates to apply the laser beam, thereby performing main scanning. The fθ lens 20 makes constant the speed of applying the laser beam coming from the polygon mirror 19. The mirrors 21*a* and 21*b* reflect the laser beam coming from the fθ lens 20. The relay lens 22 adjusts the focal point at which the laser beam reflected by the mirrors 21*a* and 21*b* is focused on the photosensitive drum 27. The scanner unit 16 illuminates or scans the surface of the photosensitive drum 27, as the laser beam that the laser light emission section emits in accordance with print data is reflected by the polygon mirror 19, passes through the fθ lens 20, is reflected by the reflection mirror 21*a*, passes through the relay lens 22 and is reflected by the reflection mirror 21*b*.

The fixing unit 18 is disposed downstream of the process cartridge 17. The fixing unit 18 includes a heating roller 41, a press roller 42, and a pair of conveyer rollers 43. The press roller 42 presses a paper sheet onto the heating roller 41. The conveyer rollers 43 are provided downstream of the heating roller 41 and press roller 42. The heating roller 41 has a hollow cylinder and a metal-made halogen lamp 41*a* provided in the cylinder for heating the cylinder. Thus, the heating roller 41 heats and fixes the toner transferred to a paper sheet 3 in the process cartridge 17, while the paper sheet 3 is passing between the heating roller 41 and the press roller 42. Thereafter, the conveyer rollers 43 transport the paper sheet 3 into the sheet discharge path 44. The sheet feed rollers 45 feed the paper sheet 3 onto the sheet discharge tray 46, with the printed side of the sheet 3 turned downwards.

2. Configuration of the Process Cartridge

Figure 2:
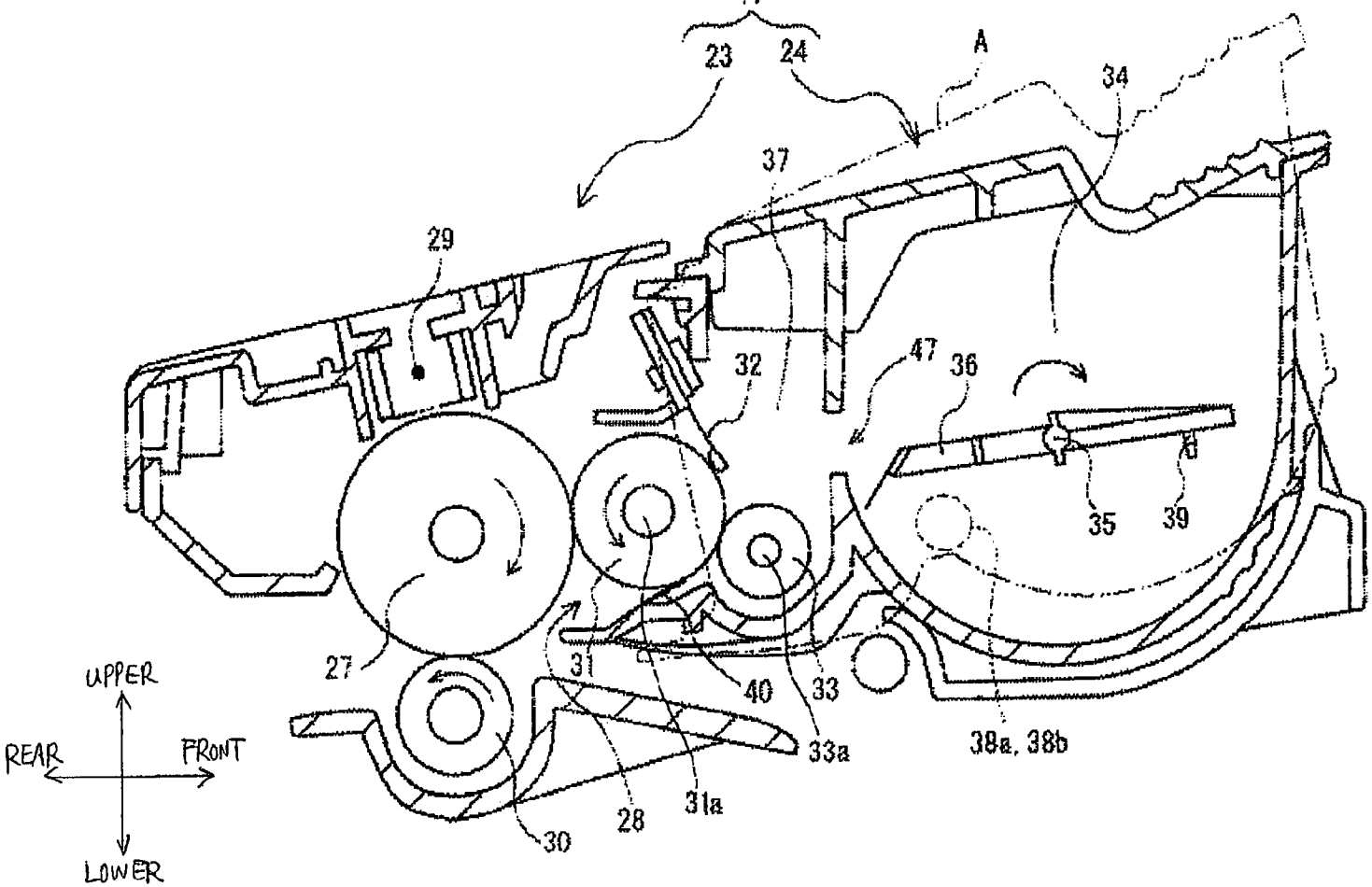
FIG. 2 is a vertical cross-sectional view of a process cartridge used in the laser printer.

As shown in FIG. 2, the process cartridge 17 includes a drum cartridge 23 and a developer cartridge 24. The developer cartridge 24 is configured to be detachably mounted on the drum cartridge 23.

(1) Configuration of the Drum Cartridge

The drum cartridge 23 includes a photosensitive drum 27, a scorotron charger 29, and a transfer roller 30.

The photosensitive drum 27 of the drum cartridge 23 is disposed at the side of a development roller 31, with its axis extending parallel to the shaft 31*a* of the development roller 31. The drum 27 can rotate in the direction of the arrow (clockwise direction in FIG. 2), in contact with the developing roller 31. The photosensitive drum 27 includes an electrically conductive base and a positively chargeable organic photosensitive coating provided on the base. The coating is a charge-transferring layer in which charge-generating material is dispersed. When the photosensitive drum 27 is irradiated with a laser beam, the charge-generating material absorbs the light and generates electric charge. The charge-transferring layer transfers the electric charge to the surface of the photosensitive drum 27 and to the electrically conductive base. The electric charge cancels out the surface potential of the scorotron charger 29. As a result, a potential difference develops between any irradiated part of the drum surface and any other part thereof. Thus, an electrostatic latent image is formed on the photosensitive drum 27 by scanningly irradiating a laser beam in accordance with the print data.

The scorotron charger 29 is located above the photosensitive drum 27, spaced away from the drum 27 by a predetermined distance so that the charger 29 may not contact the drum 27. The scorotron charger 29 is of the type that performs corona discharge by using a discharging wire made of, for example, tungsten. When turned on by a charging-bias circuit unit (no shown), the scorotron charger 29 apply a positive charge uniformly to the surface of the photosensitive drum 27.

The transfer roller 30 is provided downstream of the development roller 31, with respect to the rotation direction of the photosensitive drum 27. The transfer roller 30 is supported to be able to rotate in the direction of the arrow (counterclockwise direction in FIG. 2). The transfer roller 30 is composed of a roller shaft made of metal and a roller made of ion-conducting rubber. The roller is mounted on the roller shaft. To transfer an image, a transfer bias is applied to the transfer roller 30 from a transfer-bias circuit unit (not shown). The transfer bias thus applied to the transfer roller 30 provides a potential difference that attracts toner from the surface of the photosensitive drum 27 to the surface of the transfer roller 30.

In the laser printer 1, after the transfer roller 30 transfers a toner from the photosensitive drum 27 to a paper sheet 3, the residual toner remaining on the surface of the photosensitive drum 27 is collected by the development roller 31, i.e., a so-called cleanerless method.

(2) Configuration of the Developer Cartridge

The developer cartridge 24 has a housing 25, a development roller 31, a supply roller 33, and an agitator 36. The housing 25 is shaped like a rectangular box as a whole (see FIG. 3). The development roller 31 is supported on the housing 25.

As shown in FIG. 2, a toner hopper 34 filled with toner is provided in front of the housing 25. The development roller 31 and the supply roller 33 are provided at the rear of the housing 25.

The toner hopper 34 is filled with developer, which the supply roller 33 will supply to the development roller 31. In the illustrative aspects, toner consisting of one positive electric non-magnetic component is used as developer. The toner is polymerized toner prepared by co-polymerizing a polymerizable monomer such as a styrene-based monomer (e.g., styrene) and an acrylic monomer such as acrylic acid, alkyl (C1-C4) acrylate or alkyl (C1-C4) methacrylate by a known polymerization method such as suspension polymerization. The polymerized toner thus prepared contains coloring agent and wax. The coloring agent is, for example, carbon black. The polymerized toner contains an additive such as silica, too, and therefore excels in flowability.

Figure 4:
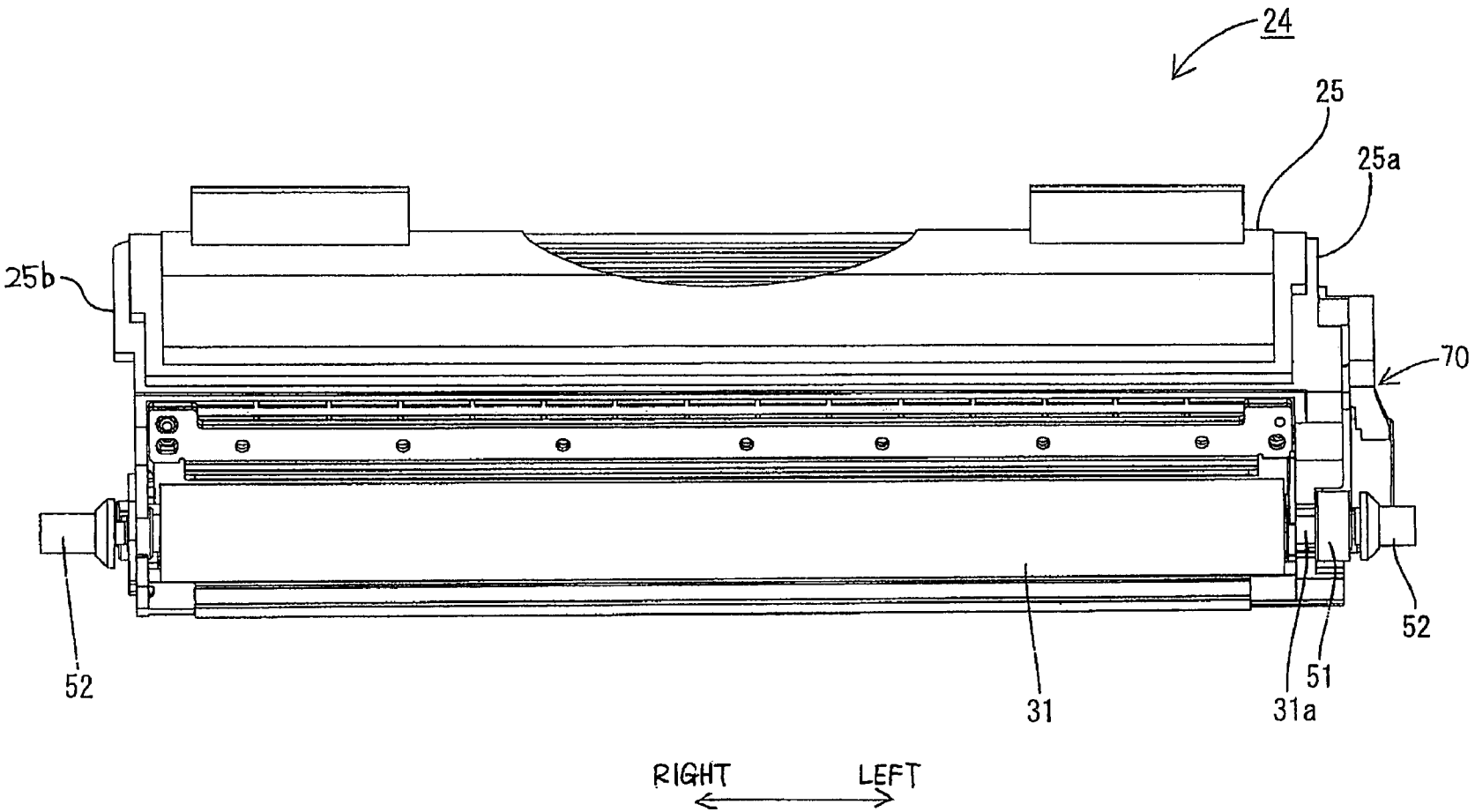
FIG. 4 is a rear view of the developer cartridge.

As shown in FIG. 4, the development roller 31 is provided in an opening formed in the lower part of the rear wall of the housing 25 (the left-hand part in FIG. 2). The development roller 31 is rotatable in the arrow direction shown in FIG. 2 (i.e., counterclockwise direction). The development roller 31 is composed of a shaft 31*a* made of metal and a roller made of electrically conductive rubber. The rubber roller is mounted on the metal shaft 31*a*. A developing bias is applied to the development roller 31 from a developing-bias circuit unit (not shown).

The supply roller 33 is disposed in front of the development roller 31. The supply roller 33 is disposed oppose to the photosensitive drum 27 with respect to the development roller 31. The supply roller 33 is pressure contact with the development roller 31, compressing the development roller 31 slightly. The supply roller 33 is composed of a shaft 33*a* made of metal and a roller made of electrically conductive foam. The foam roller is mounted on the metal shaft 33*a*. The roller 33 electrically charges toner by friction, before the toner is supplied to the development roller 31.

The agitator 36 is a meshed plate having coarse mesh. The toner hopper 34 has a center shaft 35 to which a film member is attached. The film member is in sliding contact with the inner surface of the hopper 34 when the agitator 36 rotates. The center shaft 35 supports the agitator 36 in the center part of the hopper 34. As the agitator 36 is rotated in the direction of the arrow (clockwise direction in FIG. 2), the agitator stirs the toner contained in the toner hopper 34.

Figure 3:
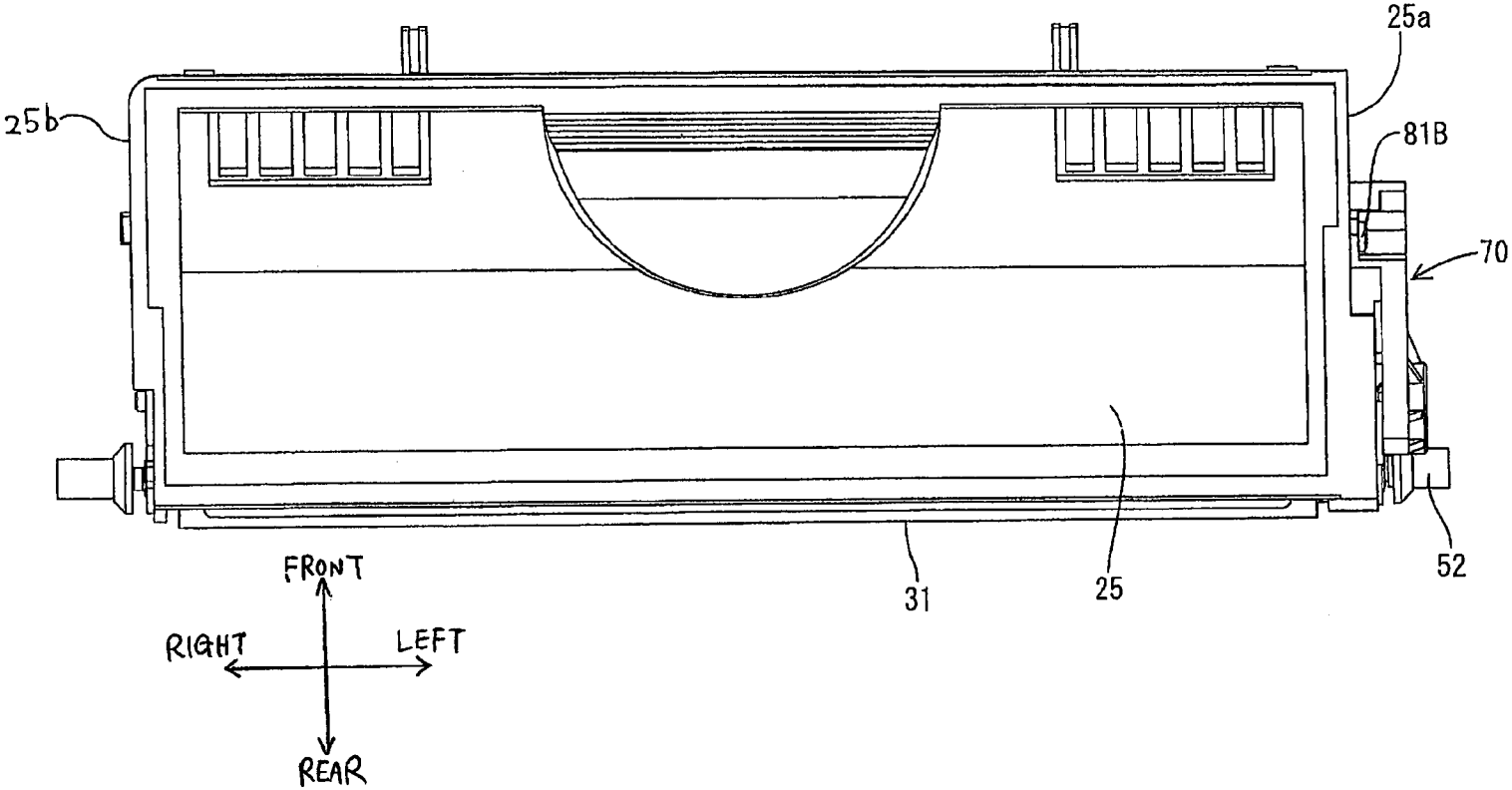
FIG. 3 is a top view of a developer cartridge used in the laser printer.
Figure 5:
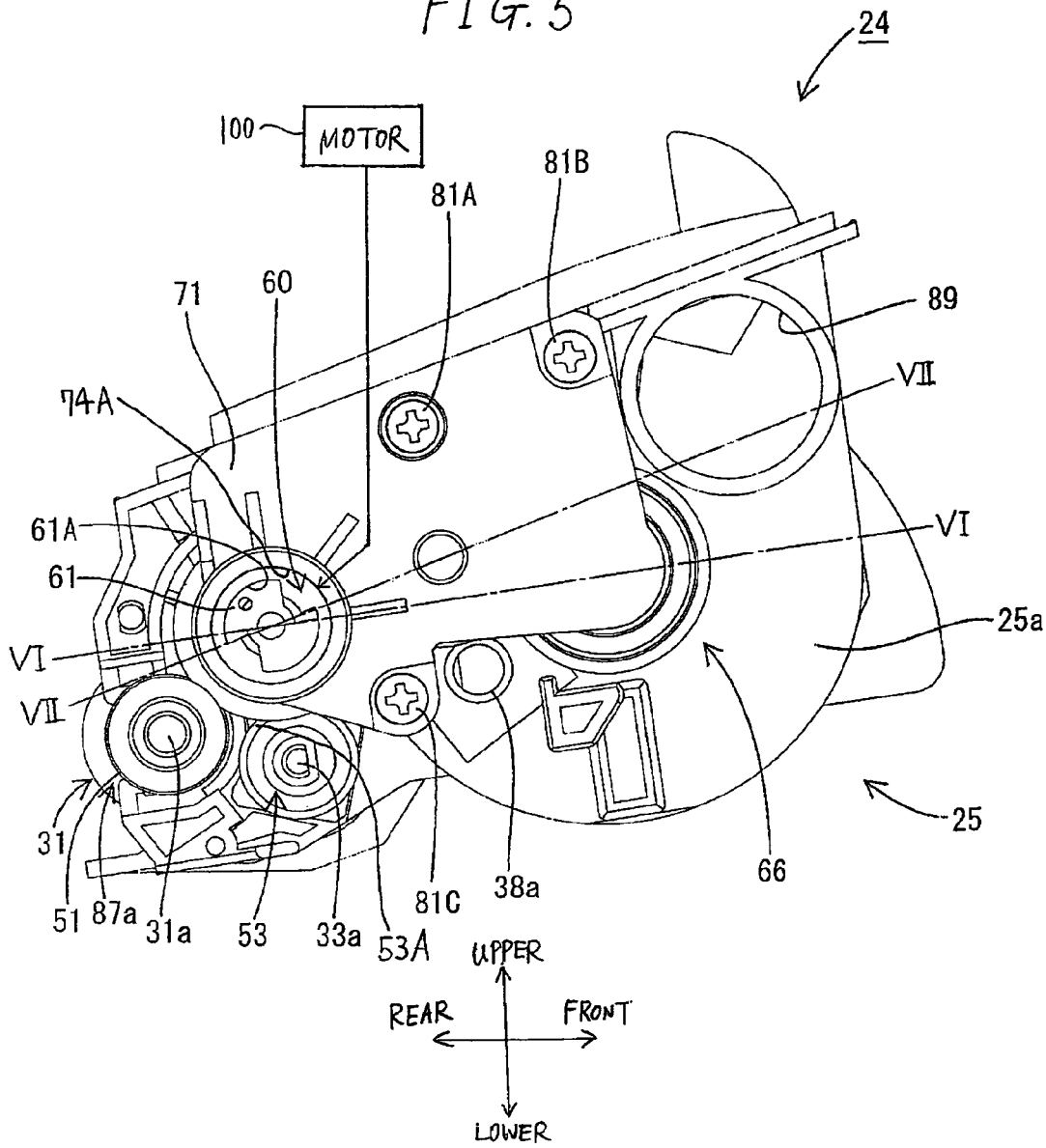
FIG. 5 is a left side view of the developer cartridge.
Figure 6:
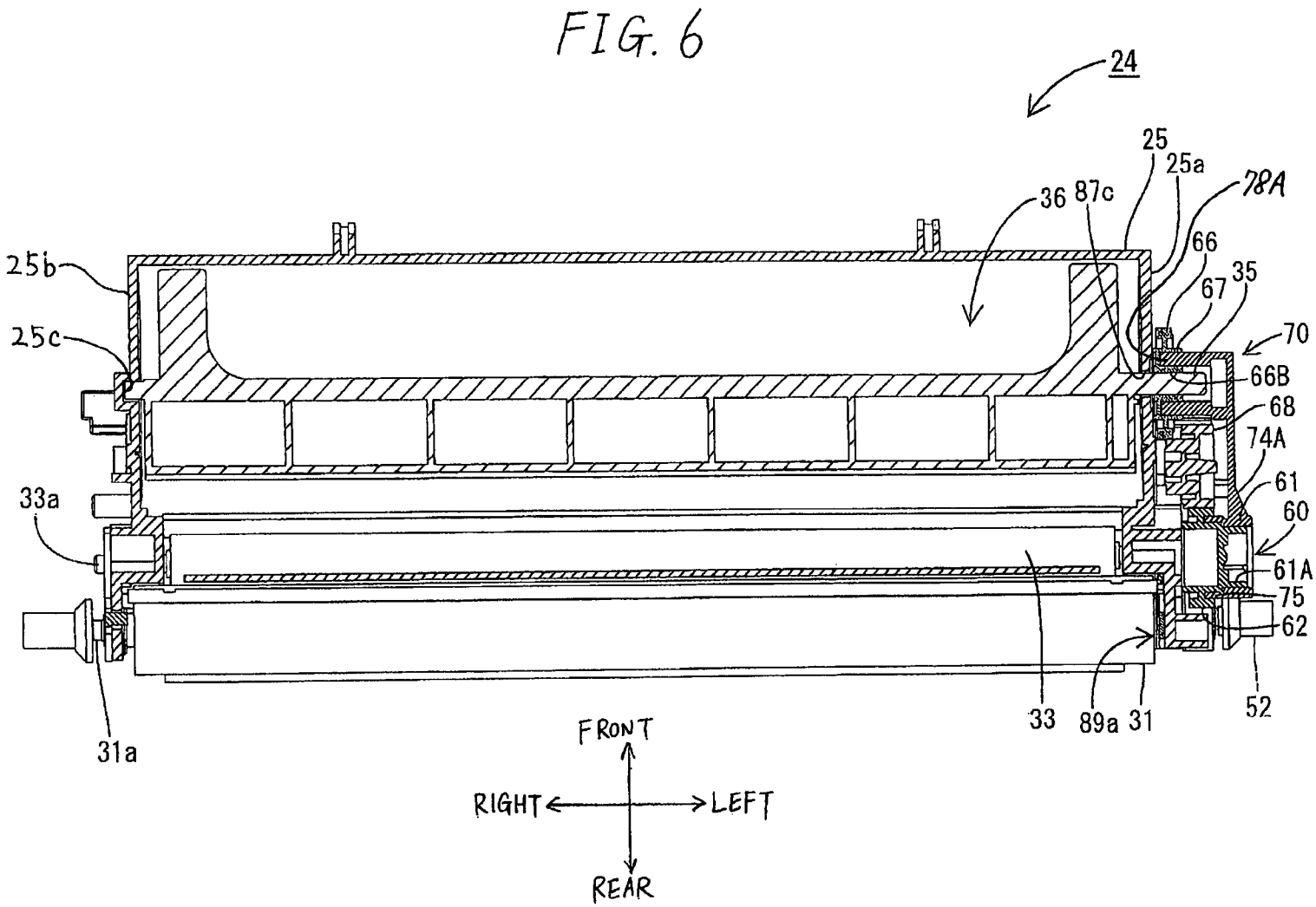
FIG. 6 is a cross-sectional view of the developer cartridge, taken along a line VI-VI in FIG. 5.
Figure 7:
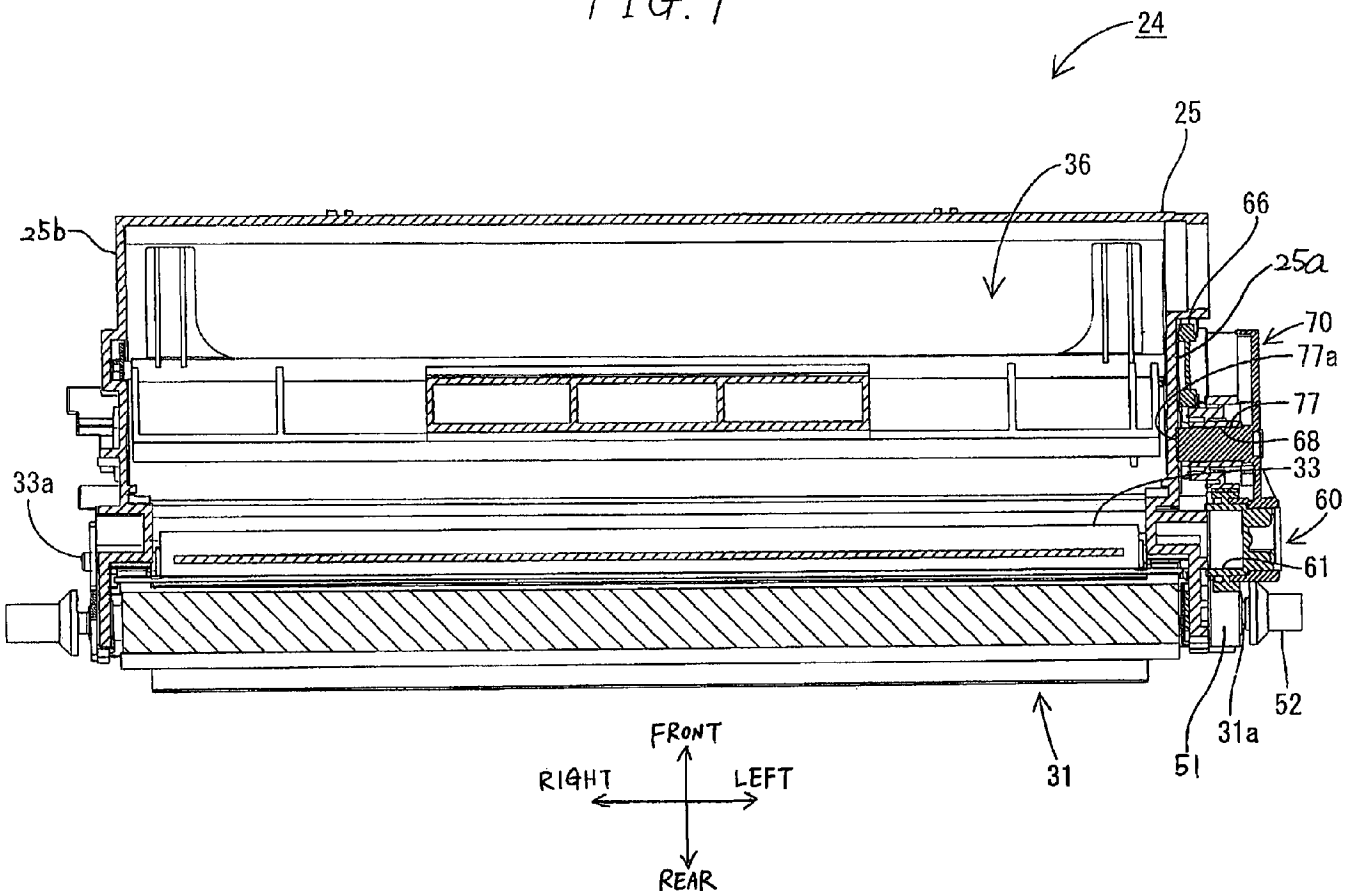
FIG. 7 is a cross-sectional view of the developer cartridge, taken along a line VII-VII in FIG. 5.
Figure 8:
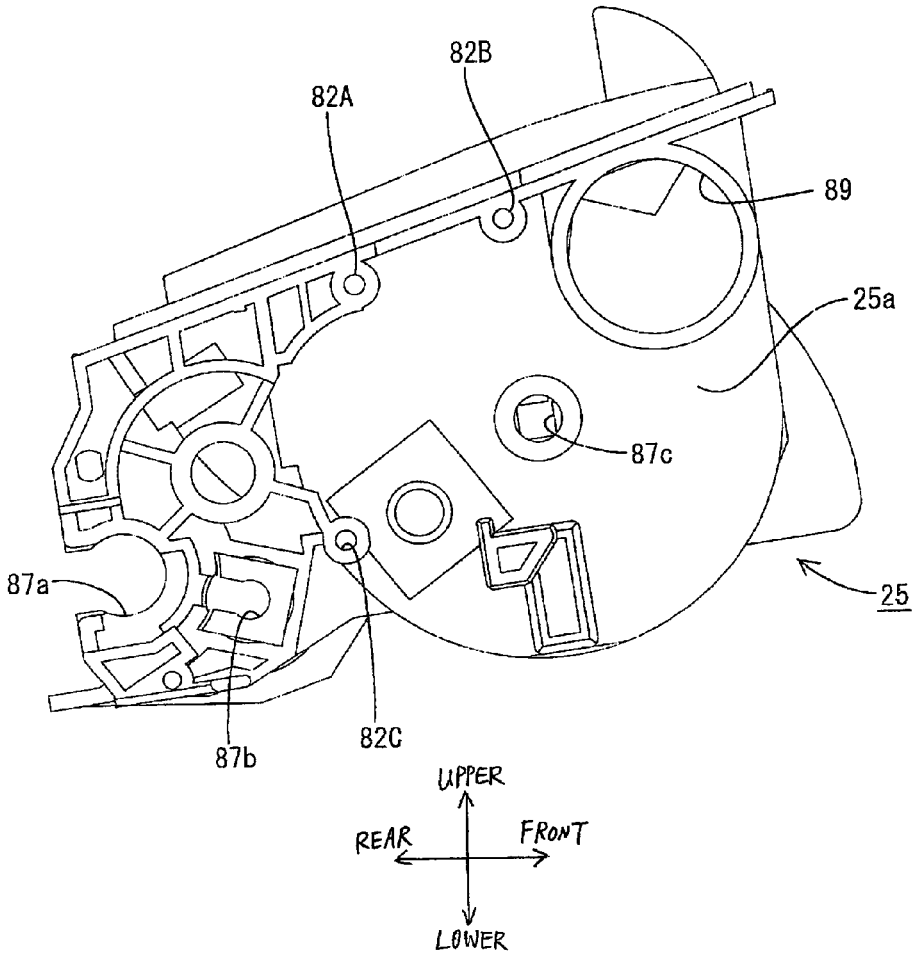
FIG. 8 is a left side view of a housing of the developer cartridge.

As shown in FIGS. 3 and 4, the housing 25 has a left side surface 25*a* and a right side surface 25*b*. The left side surface 25*a* is the surface on the left side as viewed in the direction of inserting the process cartridge 17 into the laser printer 1, and the outer surface of the housing 25. The right side surface 25*b* is the outer surface on the right side. As shown in FIGS. 5, 6, and 8, bearings 87*a*, 87*b* and 87*c* are provided on the left side surface 25*a* of the housing 25. The bearings 87*a*, 87*b* and 87*c* rotatably support the shaft 31*a* of the development roller 31, the shaft 33*a* of the supply roller 33, and the shaft 35 of the agitator 36, respectively. The shafts 31*a*, 33*a*, and 35 extend outwards from the left side surface 25*a* of the housing 25. The bearings 87*b* and 87*c* are through-holes formed through the left side surface 25*a*. As shown in FIG. 8, the bearing 87*a* of the development roller 31 opens toward the rear of the housing 25. The shaft 31*a* of the development roller 31 can therefore be removed from the rear of the housing 25 in order to remove the development roller 31 from the housing 25. The left side surface 25*a* has no bosses or holes in which an input gear 60 (described later) is fitted. A part of the left side surface 25*a* that faces the input gear 60 is a substantially flat surface.

Through-holes, serving as bearings, are formed in the right side surface 25*b* of the housing 25, as in the left side surface 25*a*. The bearings support the shaft 31*a* of the development roller 31 and the shaft 33*a* of the supply roller 33. As shown in FIG. 6, the bearing for supporting the shaft 35 of the agitator 36 on the right-hand side is formed as a recess 25*c* (not a through-hole) that is formed in the inner surface of the toner hopper 34.

A rotational force that rotates the development roller 31, supply roller 33, and agitator 36 is transmitted from a motor 100 (FIG. 5) through a gear transmission mechanism. The motor 100 is disposed in the main body of the laser printer 1. The gear transmission mechanism includes a plurality of gears and is provided at the left side surface 25*a* of the housing 25.

<Configuration of the Gear Transmission Mechanism>

Figure 9:
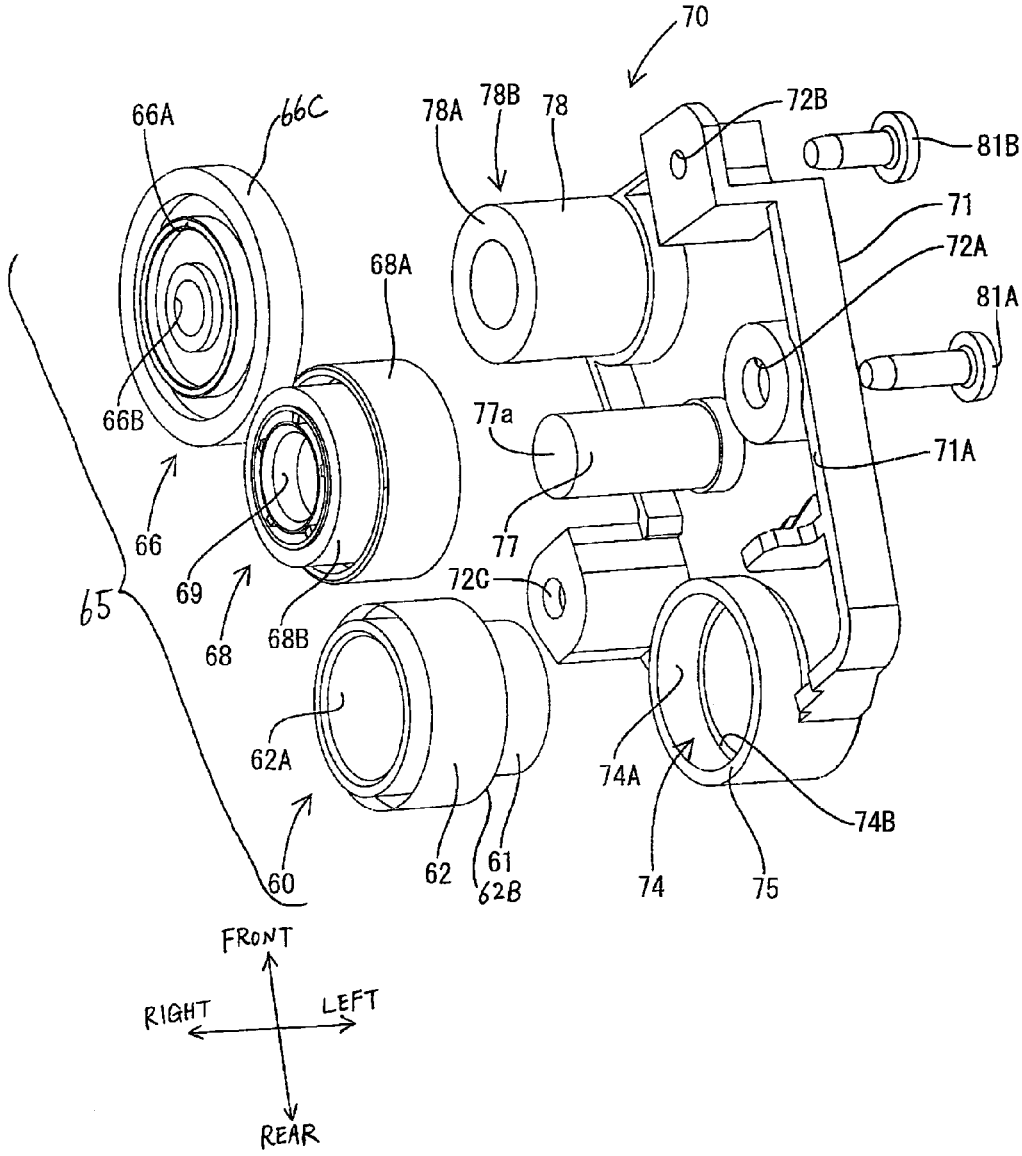
FIG. 9 is a perspective view of a support member and gears in the developer cartridge.

As shown in FIG. 5, the gear transmission mechanism includes a development gear 51, a supply gear 53, the input gear 60, an agitator gear 66, and an idle gear 68 (see FIG. 9). The input gear 60, agitator gear 66, and idle gear 68 are referred to as transmission gears 65 (see FIGS. 9 and 10). The development gear 51 is coupled to the shaft 31*a* of the development roller 31. The supply gear 53 is coupled to the shaft 33*a* of the supply roller 33. The input gear 60 receives the driving force from the motor 100. The agitator gear 66 is coupled to the shaft 35 of the agitator 36. The idle gear 68 transmits the driving force from the input gear 60 to the agitator gear 66.

As shown in FIGS. 4 and 5, the development gear 51 is shaped like a hollow cylinder having a through-hole that has a circular cross-section. The development gear 51 is mounted on the shaft 31*a* of the development roller 31, such that the left-end portion of the shaft 31*a* protrudes from the development gear 51. The development gear 51 is fixed to the shaft 31*a*, clamped at both sides by the fasteners mounted on the shaft 31*a*. The development gear 51 is thereby prevented from rotating relative to the development roller 31. The development gear 51 has oblique teeth on its circumferential surface (i.e., helical gear).

Two engagement members 52 (see FIG. 4) are mounted on the ends of the shaft 31*a*, respectively. The engagement members 52 are engaged with grooves formed in the circumferential surface of the shaft 31*a* and are rotatable together with the shaft 31*a*.

The supply gear 53 has a substantially disc shape. As shown in FIG. 5, the supply gear 53 has a semicircular shaft hole in its center part. The left end of the shaft 33*a* of the supply roller 33, which extends from the bearing 87*b* (FIG. 8) provided in the left side surface 25*a* of the housing 25, has a semicircular cross-section and is inserted in the semicircular shaft hole of the supply gear 53. Thus, the supply gear 53 is prevented from rotating relative to the supply roller 33. The supply gear 53 has oblique teeth on its circumferential surface.

The supply gear 53 has a flange 53A on the side of the left side surface 25*a*. The flange 53A protrudes radially outwardly and is positioned between the input gear 60 and the left side surface 25*a*. Hence, the supply gear 53 cannot be removed unless the input gear 60 is removed.

Figure 10:
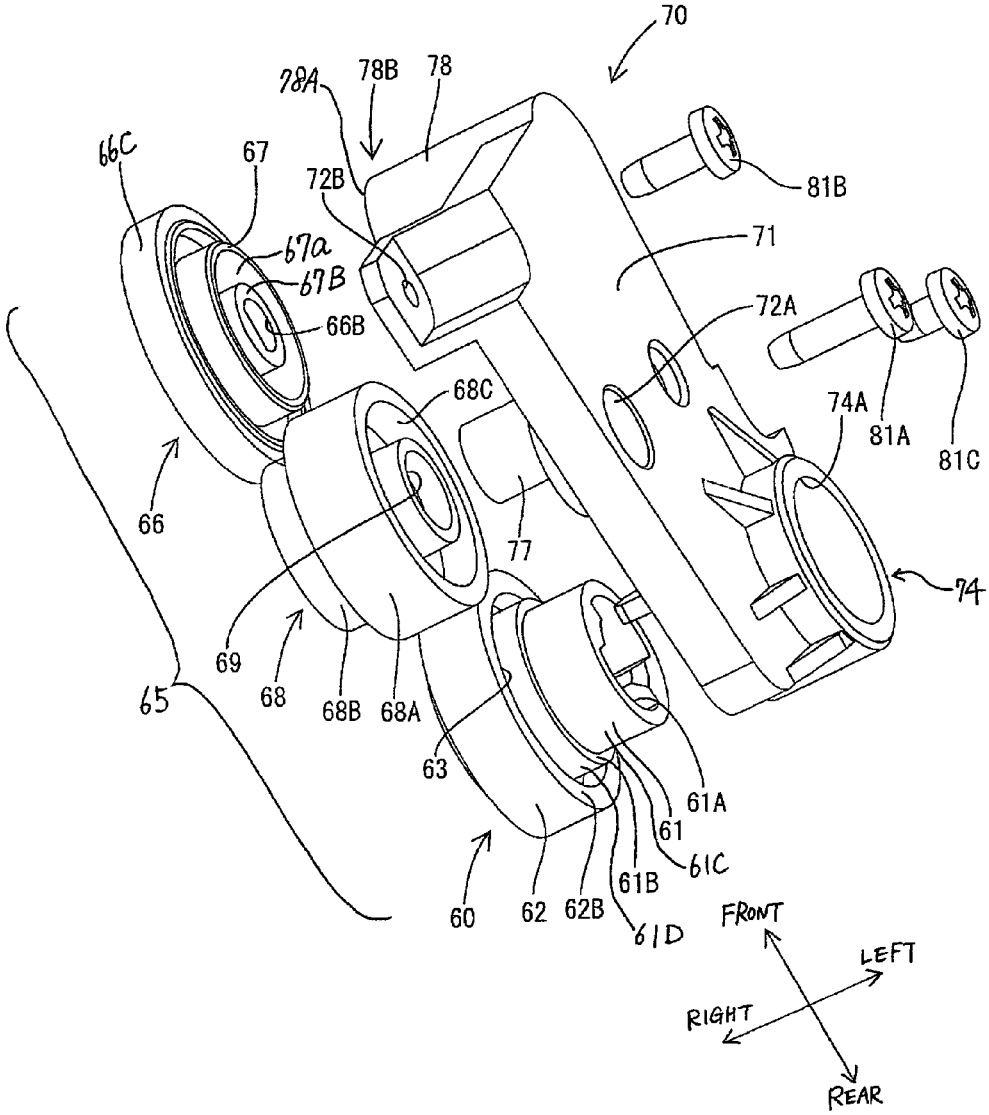
FIG. 10 is a perspective view of the support member and the gears, as viewed from a direction different from FIG. 9.

As shown in FIGS. 9 and 10, the input gear 60 has a columnar coupling part 61 and a large-diameter part 62, which are integrally formed. The coupling part 61 is coupled to the shaft of the motor 100 (FIG. 5), and receives the driving force from the motor 100. The large-diameter part 62 extends from the coupling part 61 and has a thick portion 62B. Oblique teeth are provided on the circumferential surface of the thick portion 62B.

As shown in FIG. 10, the coupling part 61 has a groove 61A formed in the outer end (left end). The coupling member (not shown), which is formed integrally with the motor shaft of the motor 100 and which is similar in shape to the groove 61A, is fitted in the groove 61A. The rotation of the motor shaft is therefore transmitted to the input gear 60.

The coupling part 61 has a step 61B at the middle portion, which extends all around the circumference. A small diameter portion 61C of the coupling part 61 outside the step 61B (the left of the step 61B) has a slightly smaller diameter than a large diameter portion 61D of the coupling part 61.

As shown in FIG. 10, the thick part 62B of the large-diameter part 62 has a groove 63 that extends all around the circumference. In the groove 63, the hollow cylindrical part 75 of an input-gear supporting part 74 (FIG. 9) to be described later is fitted.

The teeth of the input gear 60 are engaged with both the teeth of the development gear 51 and the teeth of the supply gear 53 (FIG. 5). Hence, when the motor 100 is driven, the development roller 31 and the supply roller 33 are rotated.

The agitator gear 66 has a substantially disc shape. As shown in FIGS. 9 and 10, the agitator gear 66 has a shaft hole 66B in its center part. The agitator gear 66 has a hollow cylinder that is coaxial with the shaft hole 66B and projects slightly from both left and right sides. The outward part (the left-side part) of the shaft hole 66B is semicircular (FIG. 10). The left end of the shaft 35 of the agitator 36 has a semicircular cross-section. The left end portion of the center shaft 35 protrudes from the left side surface 25*a* of the housing 25, and is inserted in the shaft hole 66B. Thus, the agitator gear 66 is prevented from rotating relative to the center shaft 35.

The agitator gear 66 is a spur gear, having teeth on its circumferential surface 66C. The circumferential surface 66C protrudes slightly in the axial direction (both in the left and right directions).

As shown in FIG. 9, the agitator gear 66 has an annular projection 66A on the inner side (i.e., the side confronting the housing 25). The projection 66A has a diameter that is about half the diameter of the agitator gear 66. The projection 66A abuts on the left side surface 25*a* of the housing 25. Hence, the friction between both the agitator gear 66 and the left side surface 25*a* is small, and the agitator gear 66 can smoothly rotate.

As shown in FIG. 10, a hollow cylinder portion 67 is provided on the outer side of the agitator gear 66 (i.e., the left side). The hollow cylinder portion 67 has a diameter that is about half the diameter of the agitator gear 66. The hollow cylinder portion 67 is engaged with an agitator-gear supporting part 78 (FIG. 9) which will be described later.

As shown in FIGS. 9 and 10, the idle gear (intermediate gear) 68 has two gears 68A and 68B arranged side by side in the axial direction (i.e., left-to-right direction), formed integrally and having different diameters. The first gear 68A, or larger gear, disposed on the outer side (the left side), has oblique teeth on the outer circumferential surface. The second gear 68B, or smaller gear, disposed on the housing 25 side (the right side), have straight teeth on the outer circumferential surface.

The idle gear 68 has a circular through-hole 69 in its center part. The idle-gear supporting part 77 of a support member 70 (described later) is inserted in the through-hole 69. The idle gear 68 can therefore rotate around the idle-gear supporting part 77.

As shown in FIG. 9, the idle gear 68 (first gear 68A) has a complete annular groove in the side confronting the housing 25 (right side). As shown in FIG. 10, the idle gear 68 (second gear 68B) has a complete annular groove 68C in the outer side (left side).

This construction reduces both the friction between the idle gear 68 and a cover part 71 (support member main frame) described later and the friction between the idle gear 68 and the housing 25. The idle gear 68 can therefore rotate smoothly. Since hollow cylinder parts that are coaxial with the through-hole 69 protrude from the idle gear 68, the through-hole 69 has a large inner surface. This increases the area at which the idle gear 68 contacts the idle-gear supporting part 77 of the support member 70.

The teeth of the first gear 68A are engaged with the teeth of the input gear 60, which are oblique teeth as those of the first gear 68A. In addition, the teeth of the second gear 68B are engaged with the teeth of the agitator gear 66, which are straight teeth as those of the second gear 68B. Hence, the driving force is transmitted from the input gear 60 to the agitator gear 66. The agitator gear 66 is thus rotated.

In this configuration, the agitator gear 66 and the idle gear 68 are attached to the housing 25. As shown in FIG. 10, the agitator gear 66 is partially covered, at the outer side (left side), with the first gear 68A of the idle gear 68. In other words, the first gear 68A is located at a position further outside (further left side) of the agitator gear 66. Thus, the idle gear 68 needs to be removed in order to remove the shaft 35 of the agitator 36.

As shown in FIG. 2, the developer cartridge 24 has a layer-thickness regulation blade 32 and a seal member 40.

The layer-thickness regulation blade 32 is a leaf spring that a narrow metal strip extending in the axial direction 31*a* of the development roller 31. The blade 32 has a pressing member at one end (free end) as viewed along its shorter axis. The pressing member is made of silicone rubber and thus electrically insulating, and has a semicircular cross-section. The blade 32 is secured to the inner surface of the developer cartridge 24, at the other end (fixed end) as viewed along its shorter axis and in the vicinity of the development roller 31. The pressing member is set in resilient contact with the outer circumferential surface of the development roller 31 by an elastic force of the blade 32.

The seal member 40 is provided to prevent toner from leaking at the junction between the development roller 31 and the inner surface of the developer cartridge 24. The seal member 40 is a plastic film that extends along the shaft 31*a* of the development roller 31. The seal member 40 is secured to the inner surface of the developer cartridge 24, at one end (fixed end) as viewed along its shorter axis, and faces the layer-thickness regulation blade 32 across the development roller 31. The seal member 40 is in resilient contact with the outer circumferential surface of the development roller 31, at the other end (free end), and is positioned closer to the toner hopper 34 than to the inner surface of the developer cartridge 24.

The developer cartridge 24 can be removed from the process cartridge 17 in the following manner. First, the stopper (not shown) fastening the drum cartridge 23 and the developer cartridge 24 is released. Then, the developer cartridge 24 is rotated around the shaft 31*a* of the development roller 31 as indicated by the two-dot chain line A in FIG. 2, in such a direction that the development roller 31 moves away from the photosensitive drum 27.

The interior of the developer cartridge 24 is partitioned into the toner hopper 34 and a developing chamber 37. The developer cartridge 24 has a toner-supplying port 47, which is located between the toner hopper 34 and the developing chamber 37. The toner-supplying port 47 extends along the shaft 31*a* of the development roller 31 and has a width smaller than the diameter of the shaft 31*a* of the development roller 32. The toner-supplying port 47 controls the amount in which toner is supplied from the toner hopper 34 into the developing chamber 37.

A toner-supplying port 89 (see FIG. 5) is formed in the left side surface 25*a* of the housing 25, not interfering with the gears. The toner-supplying port 89 communicates with the toner hopper 34. Thus, toner can be supplied into the toner hopper 34 through the toner-supplying port 89.

The developer cartridge 24 has windows 38*a* and 38*b* in the left side surface 25*a* and the right side surface 25*b*, respectively. The windows 38*a* and 38*b* are used to determine whether toner remains in the developer cartridge 24. That is, an LED emits a light beam into the developer cartridge 24 through the window 38*a* formed in the left side surface 25*a*. If the light beam passes through the window 38*b* formed in the right side surface 25*b* and is detected by a photosensor (not shown), it is determined that toner remains in the developer cartridge 24. To accomplish this, two cleaners 39 made of urethane rubber or the like are secured to the ends of the agitator 36, respectively, and positioned symmetrical with respect to the shaft 35 of the agitator 36. The cleaners 39 clean the windows 38*a* and 38*b* (FIG. 2) as the agitator 36 rotates in the toner hopper 34.

As shown in FIG. 3, the support member 70 is provided outside the gear transmission mechanism disposed at the left side surface 25*a* of the housing 25. The support member 70 protects the gears of the gear transmission mechanism from outside and facilitates removal of the gears from the housing 25.

<Configuration of the Support Member>

As shown in FIG. 9, the support member 70 includes the cover part 71, an input-gear supporting part 74 supporting the input gear 60, an idle-gear supporting part 77 supporting idle gear 68, and an agitator-gear supporting part 78 supporting the agitator gear 66. The cover part 71 is a substantially rectangular flat plate.

The input-gear supporting part 74 is a hollow cylinder part provided at the rear part of the cover part 71 and has a circular hole 74A. The input-gear supporting part 74 extends from both left and right sides of the cover part 71.

The circular hole 74A has a diameter (the inside diameter of the supporting part 74) slightly larger than the outside diameter of the columnar coupling part 61 of the input gear 60. As shown in FIG. 9, a step 74B is formed on the inner circumferential surface of the input-gear supporting part 74. Thus, a part 74C of the support part 74 that supports the columnar coupling part 61 has an inside diameter slightly larger than an inside diameter of another part 74D, in order to fit with the columnar coupling part 61.

The hollow cylindrical part 75 has a circular hole 74A and protrudes toward the housing 25. The hollow cylindrical part 75 is fitted in the groove 63 (FIG. 10) formed between the large diameter portion 61D and the large-diameter part 62 of the input gear 60. Further, the hollow cylindrical part 75 has such a height that the distal end thereof contacts the bottom of the groove 63. As shown in FIG. 5, the groove 61A formed in the coupling part 61 is exposed through the hole 74A at the outer side (left side) of the cover part 71.

When the support member 70 is moved in the axial direction (left-to-right direction), friction occurs between the input gear 60 and the surface of the hole 74A. The input gear 60 is applied with lubricant, which generates a viscous drag between the input gear 60 and the surface of the hole 74A. The left side surface 25*a* of the housing 25 is substantially flat, having neither bosses nor holes. Thus, the input gear 60 does not remain in the housing 25 once the support member 70 has been removed (dismounted) from the housing 25.

The idle-gear supporting part 77 has a round column shape. The idle-gear supporting part 77 protrudes toward the housing 25 substantially at the center part of the cover part 71. The idle-gear supporting part 77 is inserted in the through-hole 69 of the idle gear 68. Thus, the idle gear 68 is rotatably supported by the idle-gear supporting part 77.

The idle-gear supporting part 77 has such a height that the smooth distal end 77*a* abuts on the left side surface 25*a* of the housing 25 when the support member 70 is attached to the housing 25. The idle-gear supporting part 77 has a diameter that is slightly smaller than the diameter of the through-hole 69.

Lubricant, such as grease, is applied between the surface of the through-hole 69 and the idle-gear supporting part 77. When the support member 70 is removed (dismounted) from the housing 25, the viscous drag of the lubricant draws the idle gear 68 toward the support member 70.

The agitator-gear supporting part 78 is a hollow cylinder that has an outside diameter slightly smaller than the inside diameter of the hollow cylinder portion 67 (FIG. 10) that protrudes from the outer side of the agitator gear 66. The agitator-gear supporting part 78 has a receiving part 78B that is fitted in (or receives) the agitator gear 66. Once the receiving part 78B is fitted in the agitator gear 66, the agitator gear 66 is rotatably supported by the agitator-gear supporting part 78.

More specifically, as shown in FIG. 10, the distal end 78A of the agitator-gear supporting part 78 is fitted in a gap 67*a* between the inner circumferential surface of the hollow cylinder portion 67 and the outer circumferential surface of a protrusion 67B having the shaft hole 66B (see also FIG. 6).

The area at which the agitator gear 66 contacts the receiving part 78B of the agitator-gear supporting part 78 is larger than the area at which the shaft hole 66B of the agitator gear 66 contacts the shaft 35 of the agitator 36. Lubricant such as grease is applied between the agitator gear 66 and the agitator-gear supporting part 78. The lubricant used in the area at which the agitator gear 66 contacts the receiving part 78B has the same viscous drag per unit area as the lubricant used in the area at which the shaft hole 66B contacts the shaft 35.

Figure 11:
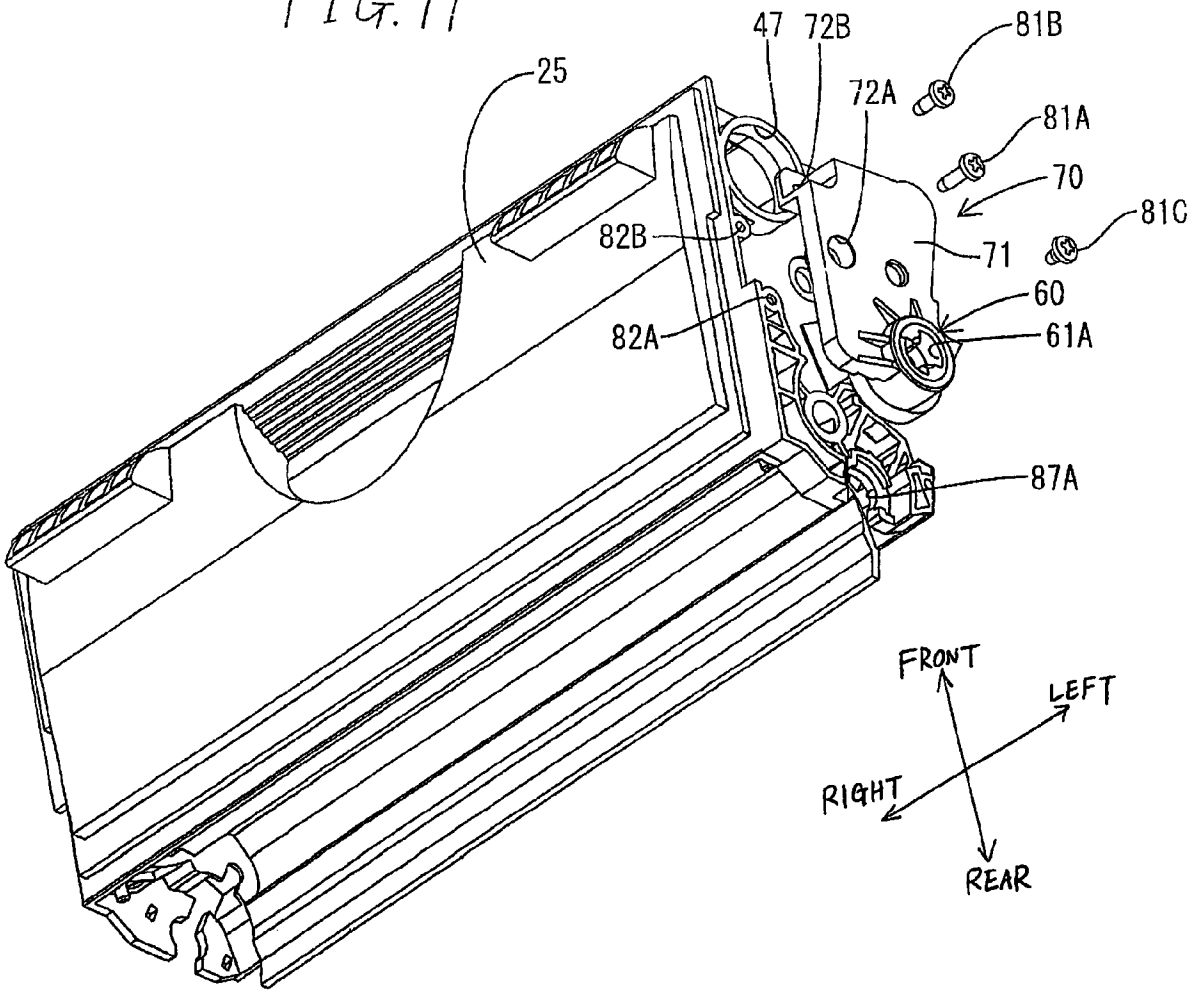
FIG. 11 is a perspective view of the support member removed (dismounted) from the housing.
Figure 12:
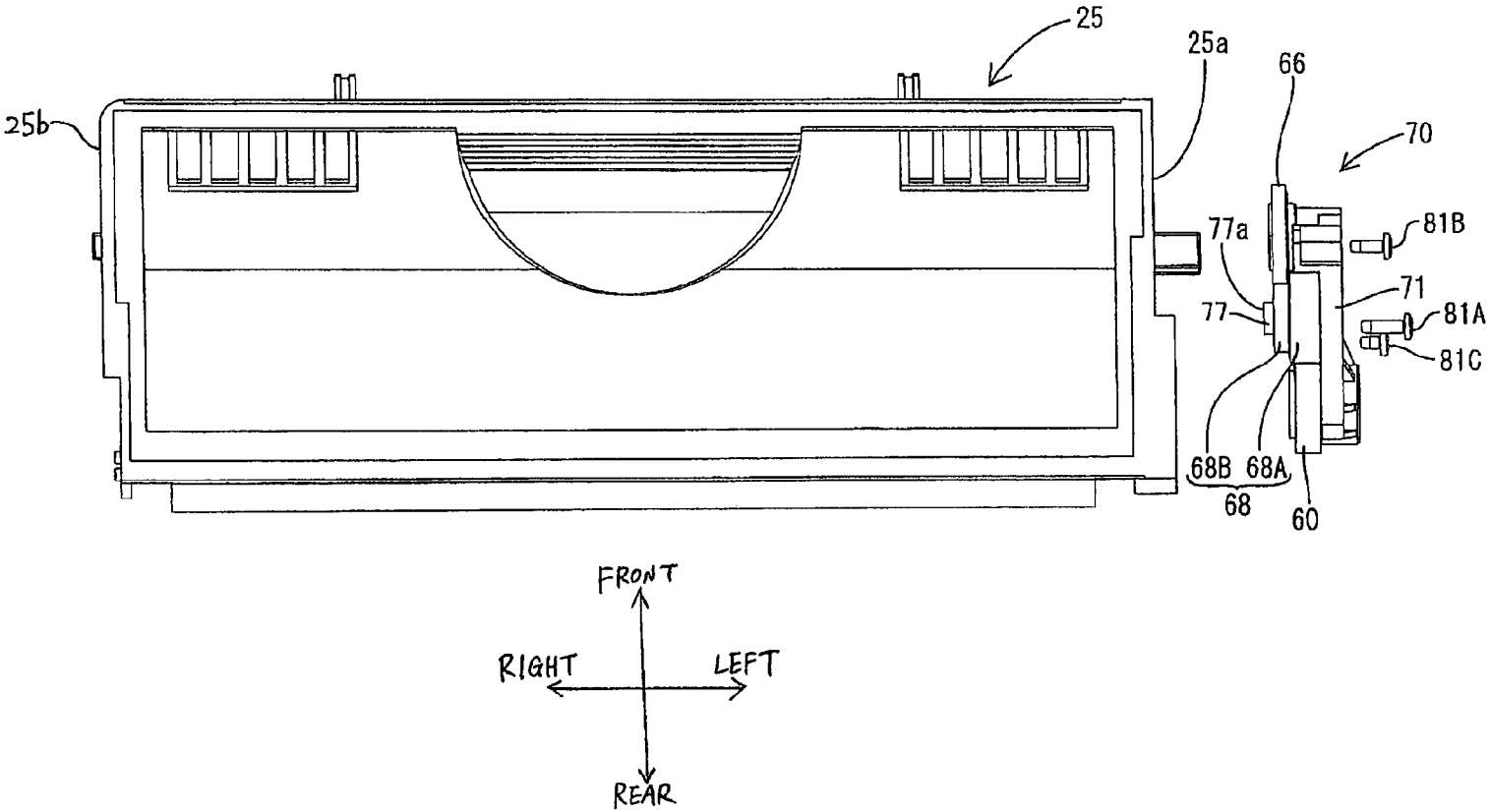
FIG. 12 is a top view of the support member removed from the housing.
Figure 13:
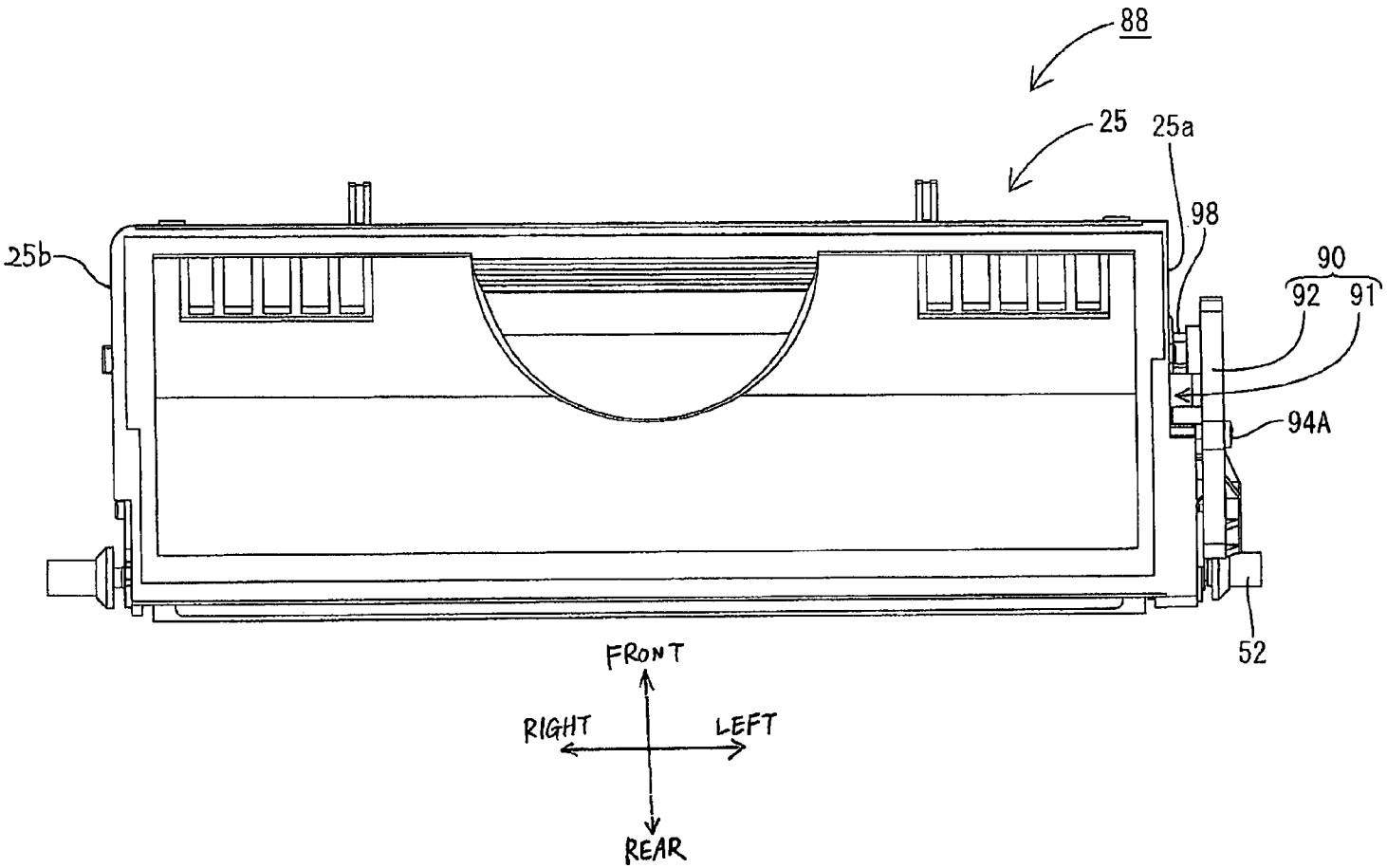
FIG. 13 is a top view of a developer cartridge according to additional aspects of the invention.
Figure 14:
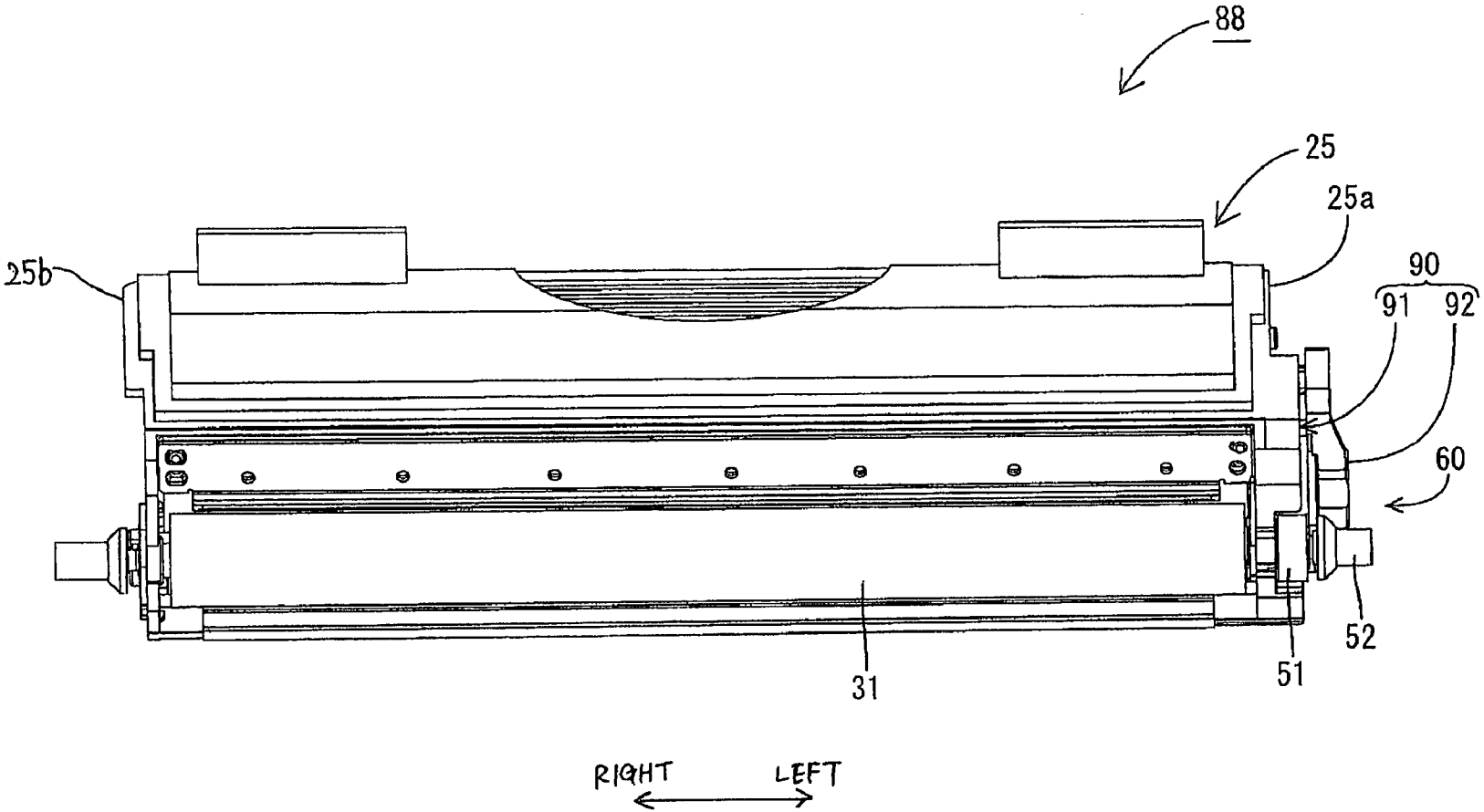
FIG. 14 is a rear view of the developer cartridge shown in FIG. 13.
Figure 15:
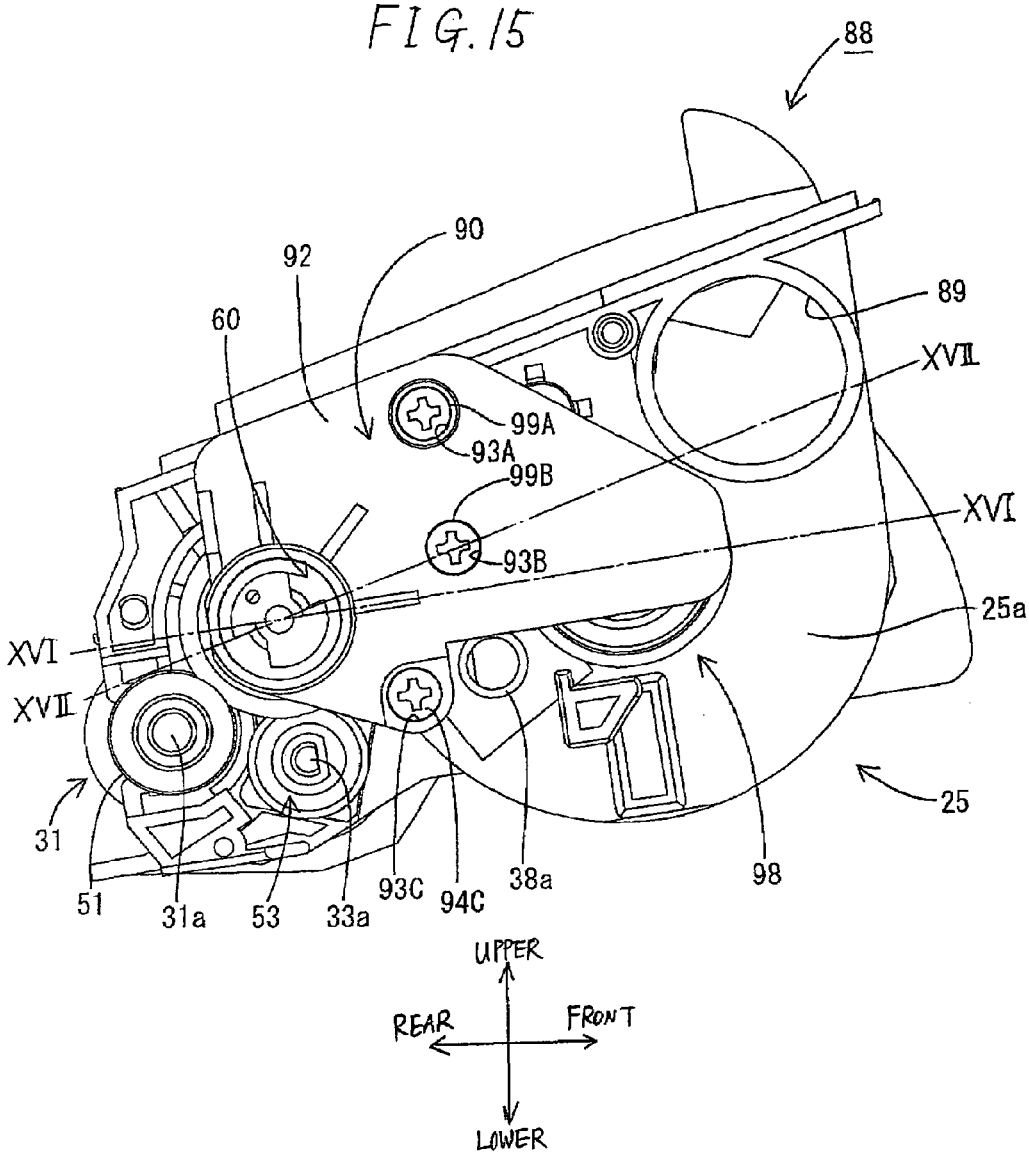
FIG. 15 is a left side view of the developer cartridge shown in FIG. 13.

Thus, as shown in FIGS. 11 and 12, the input gear 60, idle gear 68 and agitator gear 66 are drawn toward the support member 70 that has a large viscous drag acting in the axial direction, when the support member 70 is being moved away from the housing 25.

Instead, lubricants having different viscous drag per unit area may be used, such that the viscous drag between the agitator gear 66 and the agitator-gear supporting part 78 is greater than the viscous drag between the agitator gear 66 and the shaft 35 of the agitator 36. Likewise, the agitator gear 66 is drawn toward the support member 70 when the support member 70 is being moved away from the housing 25.

As shown in FIG. 9, the cover part 71 has a wall 71A, which extends from the edge toward the housing 25. Two screw holes 72A and 72B are formed in the upper part (right-hand part in FIG. 9) of the cover part 71, and one screw hole 72C is formed in the lower part (the left-hand part in FIG. 9) of the cover part 71. The screw holes 72A and 72B are located above the idle gear 68 and the agitator gear 66, respectively (namely, on the right side part of FIG. 9). The screw hole 72C is located below a point halfway between the input gear 60 and the idle gear 68 (namely, in the left-side part of FIG. 9). In the screw holes 72A, 72B and 72C, screws 81A, 81B and 81C are driven to fasten the support member 70 to the holding parts 82A, 82B and 82C integrally formed with the housing 25 (see FIG. 8). Thus, the support member 70 is secured to the housing 25.

The transmission gears 65 including the input gear 60, the idle gear 68, and the agitator gear 66 are engaged with one another and are disposed densely. Accordingly, it is difficult to dismount the development roller 31, the supply roller 33, and the agitator 36 for recycle use, unless the support member 70 and the transmission gears 65 (the input gear 60, the idle gear 68, and the agitator gear 66) are dismounted beforehand.

Next, a method of removing the transmission gears 65 (the input gear 60, the idle gear 68, and the agitator gear 66) will be described. The transmission gears 65 are removed before the development roller 31, the supply roller 33, and the agitator 36 are removed.

First, the three screws 81A, 81B and 81C are removed with a screw driver (not shown). Next, the support member 70 is pulled to the left. The transmission gears 65 (input gear 60, idle gear 68, and agitator gear 66) are therefore drawn outwards, because of the viscous drag of the lubricant applied between the input gear 60, idle gear 68, and agitator gear 66, on the one hand, and the support member 70, on the other. As shown in FIGS. 11 and 12, the agitator gear 66 is removed from the shaft 35 of the agitator 36. As a result, the input gear 60, idle gear 68, and agitator gear 66 are removed, all still supported by the support member 70.

Then, the development roller 31, supply roller 33, and agitator 36 can be removed from their respective bearings. To mount the transmission gears 65 on the housing 25, the input gear 60, the idle gear 68, the agitator gear 66, and the support member 70 are first set, as an integral unit, at a predetermined position on the housing 25. Note that the semicircular shaft hole 66B of the agitator gear 66 needs to be aligned with the left end of the semicircular cross-section of the shaft 35 of the agitator 36. Then, the support member 70 is fastened with the screws 81A, 81B and 81C. Thus, the support member 70 and the transmission gears 65 can be not only removed together from the housing 25, but also mounted together on the housing 25.

3. Effects

With the illustrative aspects, the support member 70 and the transmission gears 65 including the input gear 60, idle gear (intermediate gear) 68, and agitator gear 66 can be removed as an integral unit. The input gear 60, idle gear 68, and agitator gear 66 need not be removed separately from the support member 70. This construction enhances work efficiency.

In the above-described illustrative aspects, the development gear 51 and the supply gear 53 are removed after the support member 70 is removed. In other words, the development gear 51 and the supply gear 53 are configured to be dismounted from the housing 25 independently from the support member 70. Instead, the development gear 51 and the supply gear 53 could be removed together with the support member 70. In this case, however, the development gear 51 and supply gear 53 may be displaced from their appropriate positions, and the rollers may be driven at insufficient precision. The rotation speeds of the development roller 31 and supply roller 33 must be controlled at high precision in order to form high-quality images. In the above-described illustrative aspects, the development roller 31 and supply roller 33 can be rotated at relatively high precision because the development gear 51 and supply gear 53 are not removed together with the support member 70.

The developer cartridge 24 in the above-described illustrative aspects includes a smaller number of components than in the case where a support member has two parts that sandwiches the transmission gears 65 including the input gear 60, idle gear (intermediate gear) 68, and agitator gear 66.

In the above-described illustrative aspects, the distal end 77*a* of the idle-gear supporting part 77 abuts on the left side surface 25*a* of the housing 25. The support member 70 can therefore be stabilized in appropriate position.

Additional aspects of the invention will be described with reference to FIGS. 13 to 22 wherein like parts and components are designated by the same reference numerals to avoid duplicating description.

In the above-described illustrative aspects, the support member 70 is disposed at the outer side (left side) of the transmission gears 65. In the additional aspects, a support member 90 includes two members between which transmission gears 165 (FIGS. 19 and 20) are accommodated. The transmission gears 165 include the input gear 60, the idle gear 68, and an agitator gear 98. Thus, the support member 90 and the transmission gears 165 constitute an integral unit.

Figure 19:
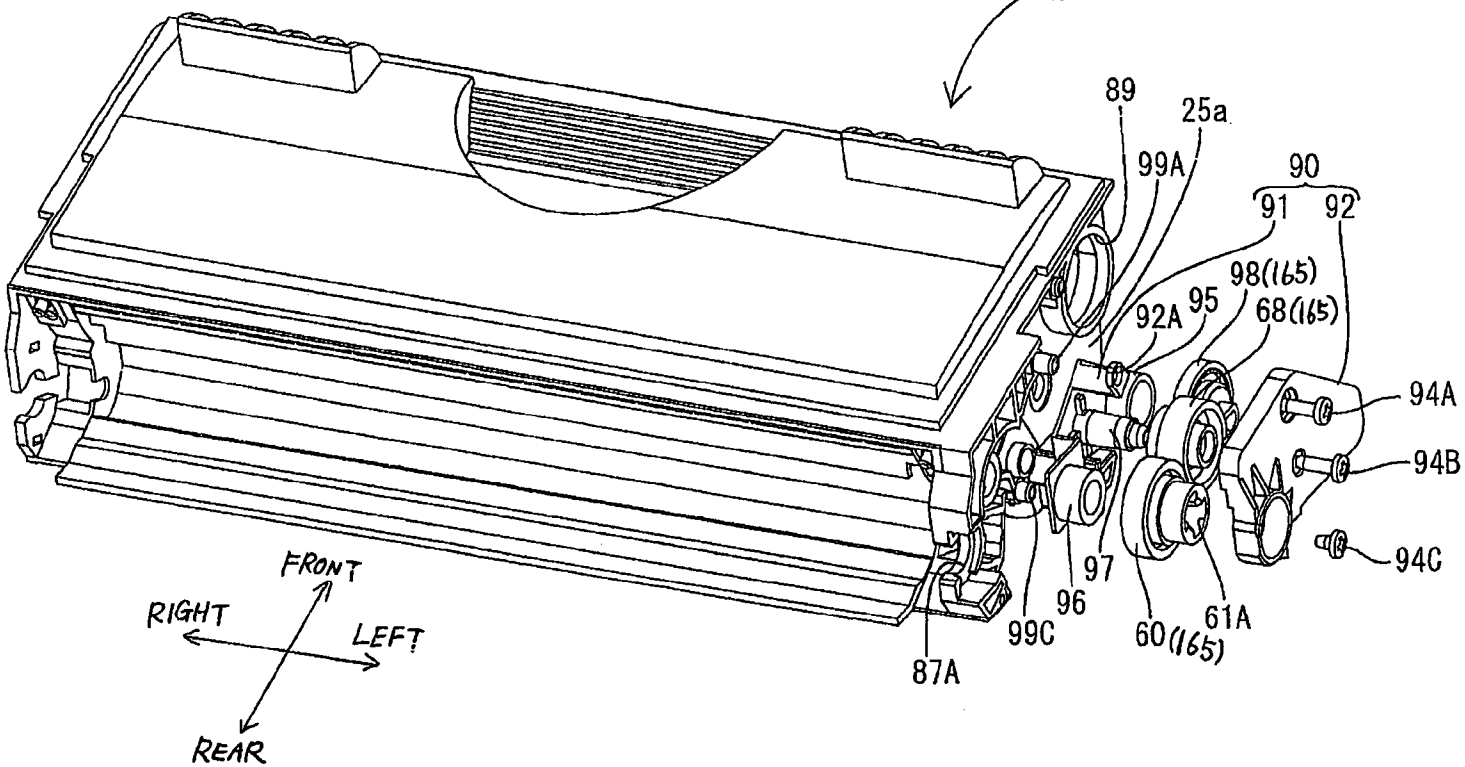
FIG. 19 is a perspective view illustrating how the support member and the gears are attached to the housing.

As shown in FIG. 19, the support member 90 includes a first frame 91 (first support frame) and a second frame 92 (second support frame). The input gear 60, idle gear 68 and agitator gear 66 are interposed between the first frame 91 and the second frame 92. The first frame 91 of the support member 90 is disposed in contact with the left side surface 25*a* of the housing 25 (see FIGS. 13 to 17).

Figure 20:
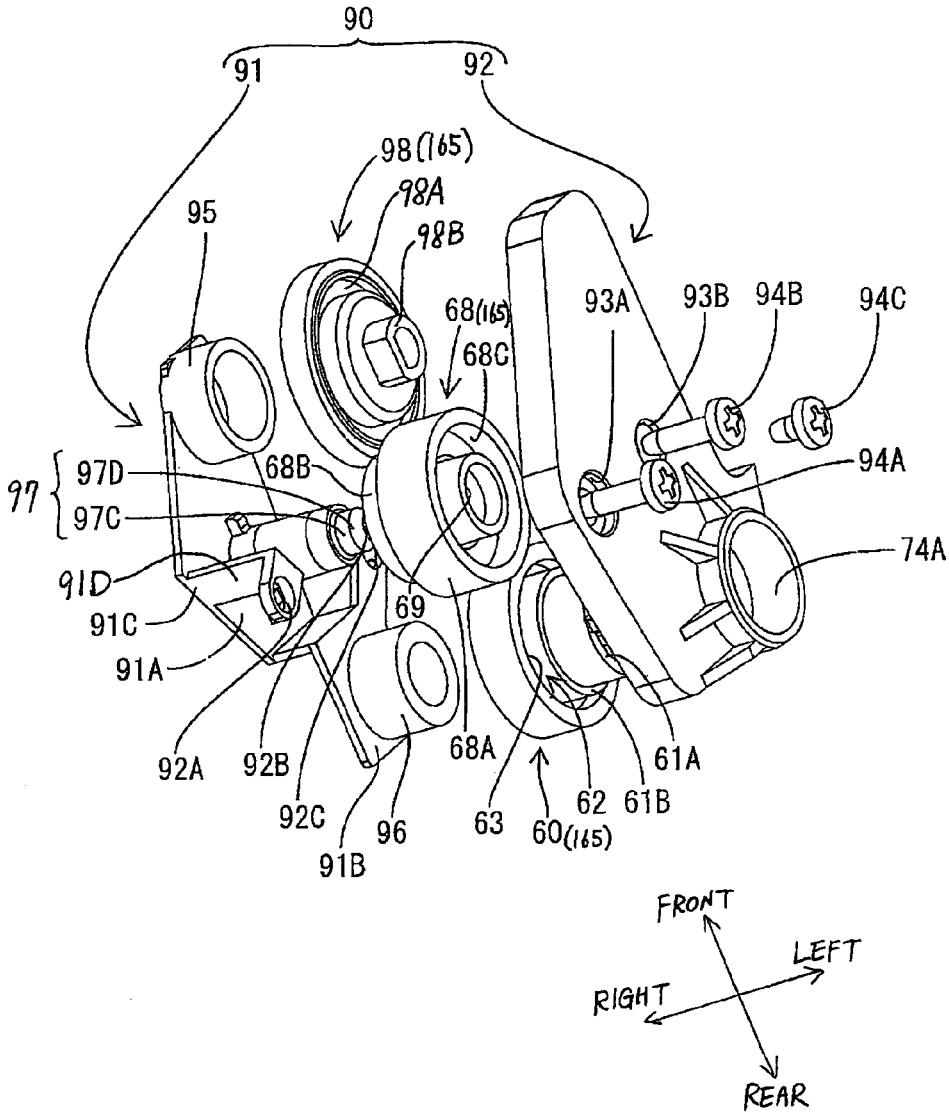
FIG. 20 is an exploded perspective view of the support member and the gears.

As shown in FIG. 20, the first frame 91 has a substantially triangular flat plate 91A. A column-shaped idle-gear supporting part 97 is provided at the center part of the flat plate 91A for rotatably supporting the idle gear 68. An agitator-gear supporting part 95 having a hollow cylinder shape protrudes outwards from the front part of the flat plate 91A for rotatably supporting the agitator gear 98. The agitator gear 98 has an annular groove 98A in the outer side (left side) and a hollow cylinder 98B having a shaft hole. In the additional aspects, the side of the housing 25 which confronts the agitator gear 98, the idle gear 68, and the input gear 60 are of the same configuration as in the above-described illustrative aspects.

The support member 90 supports the idle gear 68 once the idle-gear supporting part 97 is inserted into the through-hole 69 of the idle gear 68. The idle-gear supporting part 97 is formed in such a manner that one end portion 97D of the idle-gear supporting part 97 abuts on the second frame 92 when the first frame 91 and the second frame 92 are coupled with each other. Another end portion 97C is provided adjacent to the one end portion 97D.

The one end portion 97D of the idle-gear supporting part 97 has a diameter gradually decreasing toward its distal end. A circular screw hole 92B is formed through both the one end portion 97D and the another end portion 97C. A screw hole 93B is formed in a substantial center part of the second frame 92. A screw 94B is inserted in the screw hole 93B, through the circular through-hole 69 of the idle gear 68, and further inserted in the circular screw hole 92B. Accordingly, the first frame 91 and the second frame 92 are coupled with each other (see FIG. 17).

As shown in FIG. 20, the first frame 91 has an upper step part 91B at its rear part. An input-gear supporting part 96 shaped like a hollow cylinder protrudes outwards (toward the left) from the upper step part 91B.

A screw-hole support portion 91D is provided at an apex 91C of the triangular flat plate 91A. The screw-hole support portion 91D substantially extends outwards (toward the left). A free end of the screw-hole support portion 91D is bent upward (to the left in FIG. 20) and is formed with a screw hole 92A. The upper step part 91B extends upwards in FIG. 20 and is formed with a screw hole 92C in its distal end.

Figure 23:
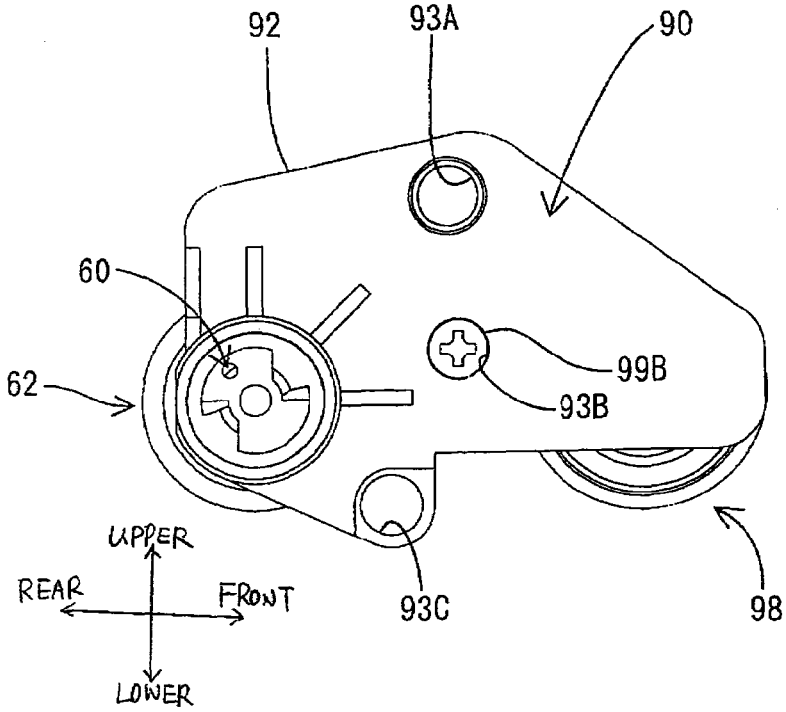
FIG. 23 is a left side view of the support member and the gears, combined together and removed from the housing.

The second frame 92 is a trapezoidal flat plate. The second frame 92 is formed with screw holes 93A and 93C (FIG. 23) in the upper and lower end parts, which align with the screw holes 92A and 92C of the first frame 91, respectively. The lower edge of the second frame 92 protrudes toward the first frame 91 and has the screw hole 93C.

Figure 18:
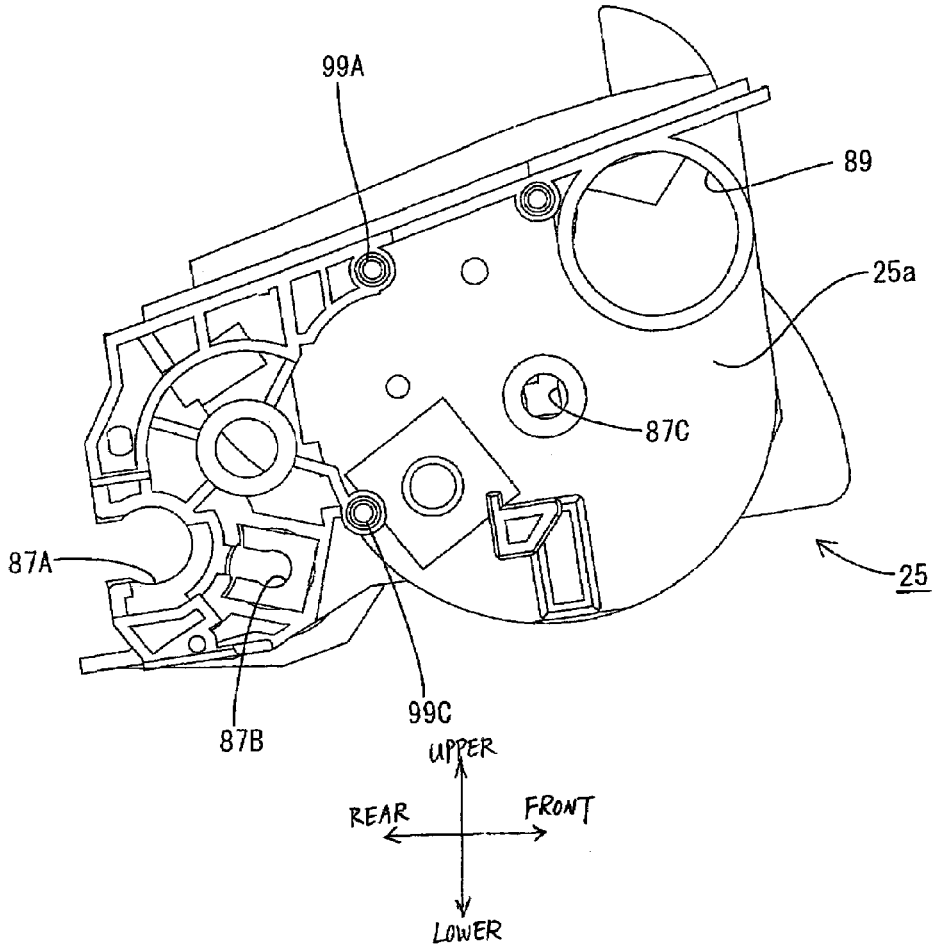
FIG. 18 is a left side view of a housing of the developer cartridge shown in FIG. 13.

As shown in FIG. 18, screw receiving portions 99A and 99C are provided on the left side surface 25*a* of the housing 25. In addition, as shown in FIG. 20, screw holes 93A and 93C (FIG. 23) are formed in the second frame 92 and the screw holes 92A and 92C are formed in the first frame 91. In this construction, the screws 94A and 94C are inserted through the screw holes 93A and 93C and the screw holes 92A and 92C, and further into the screw receiving portions 99A and 99C (FIG. 18), respectively. Accordingly, as shown in FIGS. 21 and 22, gears 60, 68, and 98 are interposed between the first frame 91 and second frame 92 and are secured to the housing 25.

Figure 16:
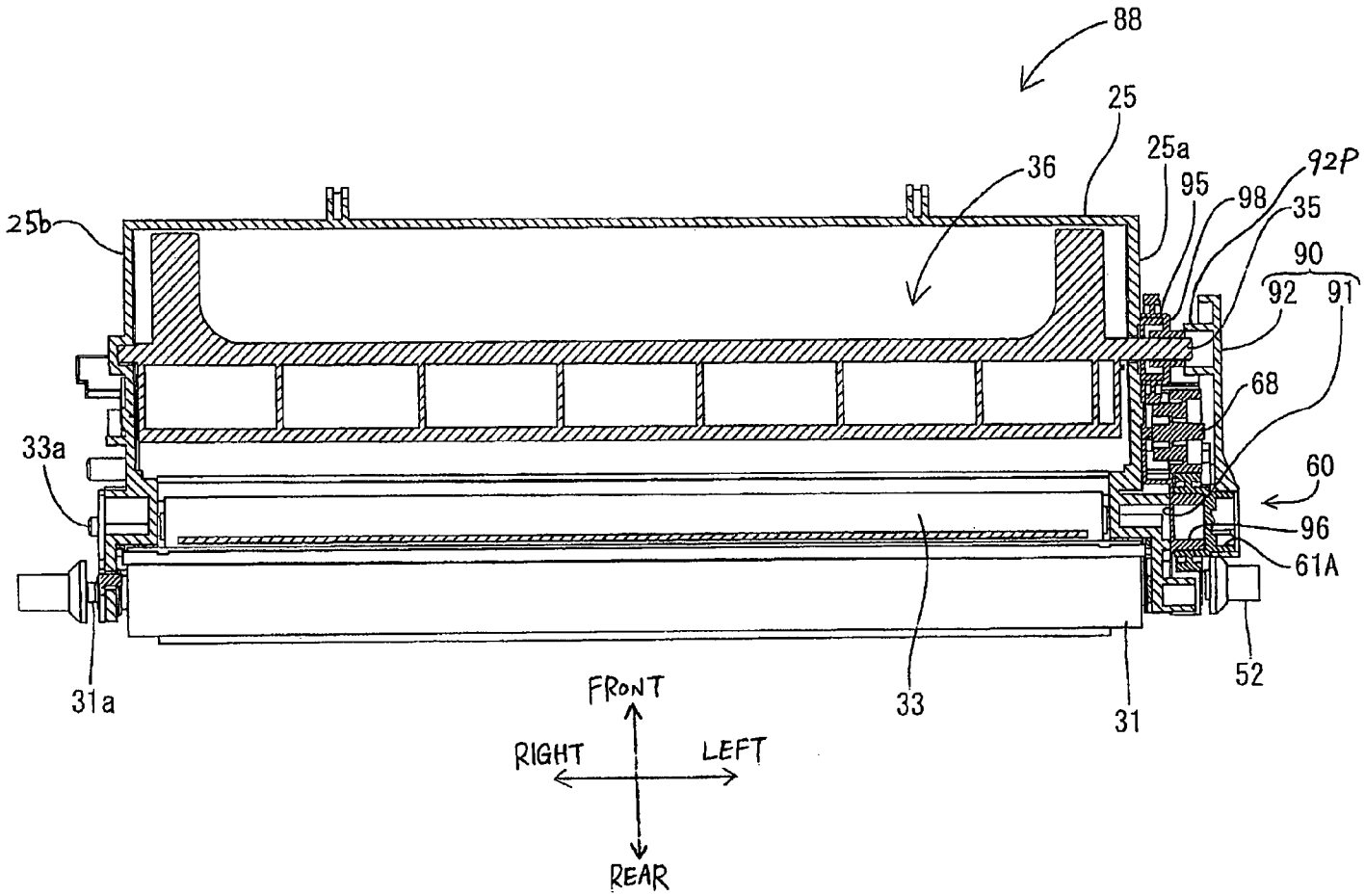
FIG. 16 is a cross-sectional view of the developer cartridge, taken along a line XVI-XVI in FIG. 15.
Figure 17:
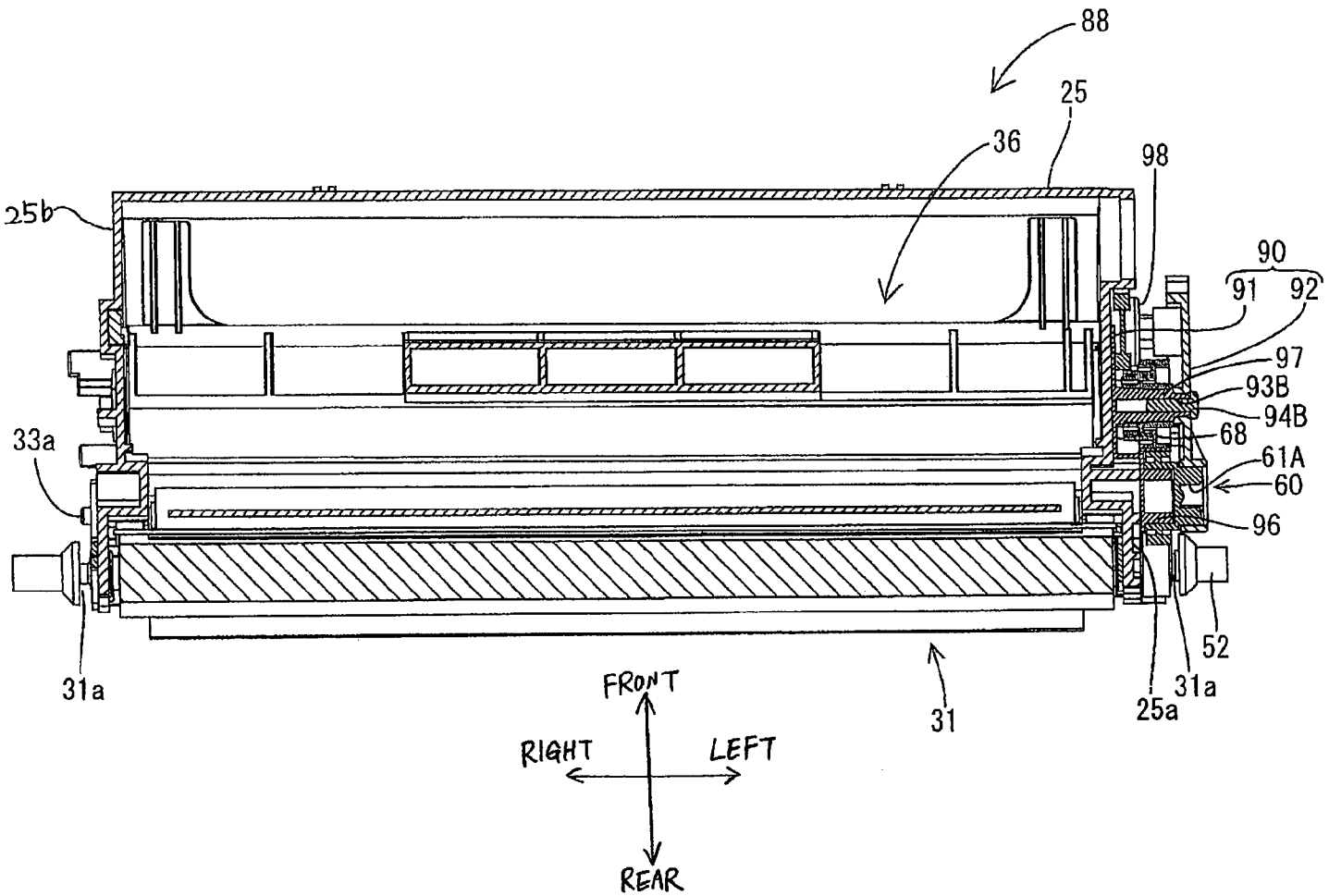
FIG. 17 is a cross-sectional view of the developer cartridge, taken along a line XVII-XVII in FIG. 15.

As shown in FIG. 20, the second frame 92 has an opening 74A in its rear end, in which the input gear 60 is disposed. As shown in FIG. 16, a hollow cylinder portion 92P extends slightly from the side of the second frame 92 which confronts the first frame 91. The hollow cylinder portion 92P houses the left end of the shaft 35 of the agitator 36.

Figure 21:
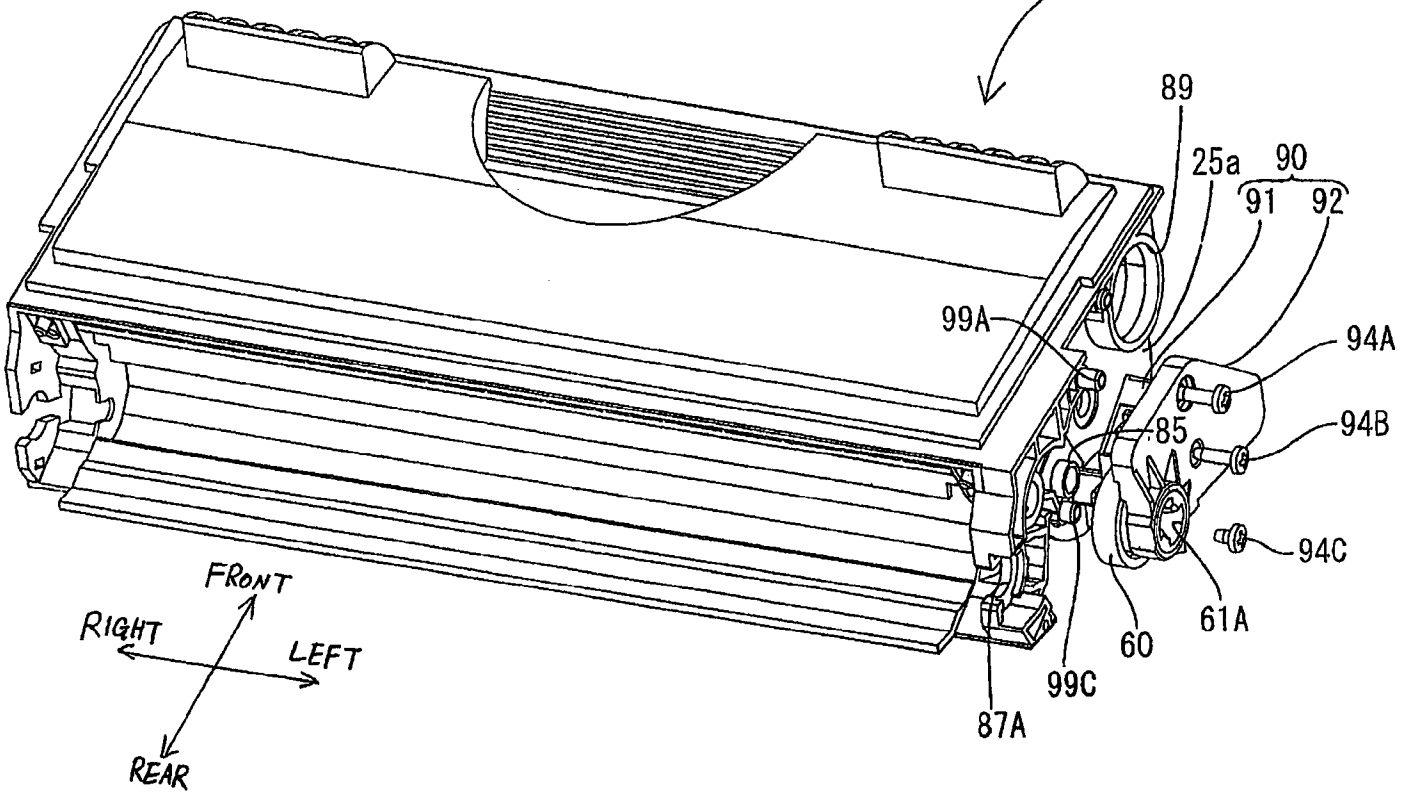
FIG. 21 is a perspective view of the developer cartridge and the support member before the support member is attached to the developer cartridge.
Figure 22:
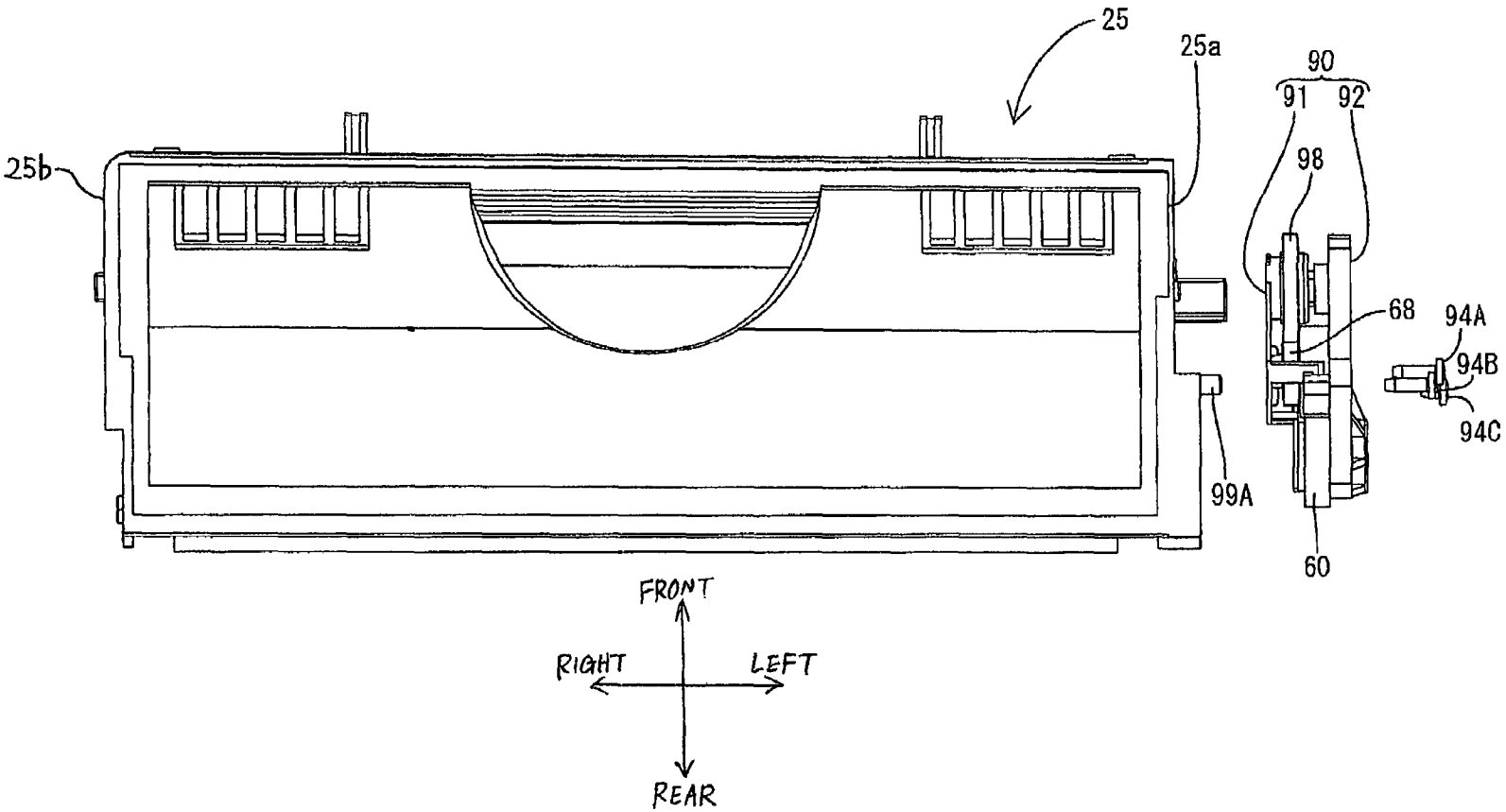
FIG. 22 is a top view of the developer cartridge and the support member before the support member is attached to the developer cartridge.
Figure 24:
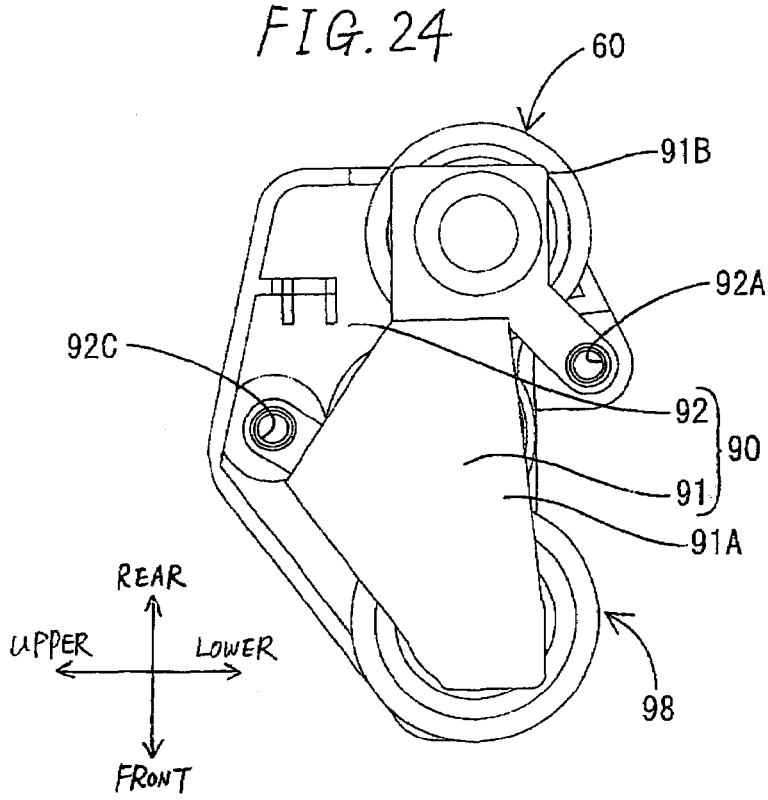
FIG. 24 is a right side view of the support member and the gears, combined and removed from the housing.

As shown in FIGS. 20 and 21, in order to remove the supply roller 33 and agitator 36, the screws 94A and 94C are pulled out with a tool such as a screw driver. The support member 90 and the transmission gears 165 (input gear 60, idle gear 68, and agitator gear 98), which constitute an integral unit, are then removed from the housing 25 (see also FIGS. 23 and 24). In this way, the supply roller 33, the agitator 36, and the like can be removed.

Thus, in the additional aspects, the transmission gears 165 (input gear 60, idle gear 68, and agitator gear 98) are prevented from dropping off from the support member 90, when the support member 90 is removed from the housing 25 together with the transmission gears 165. Since the frames 91 and 92 are in contact with each other, the frames 91 and 92 are stable in position.

While the invention has been described in detail with reference to the above aspects thereof, it would be apparent to those skilled in the art that various changes and modifications may be made therein without departing from the spirit of the invention.

Figure 25:
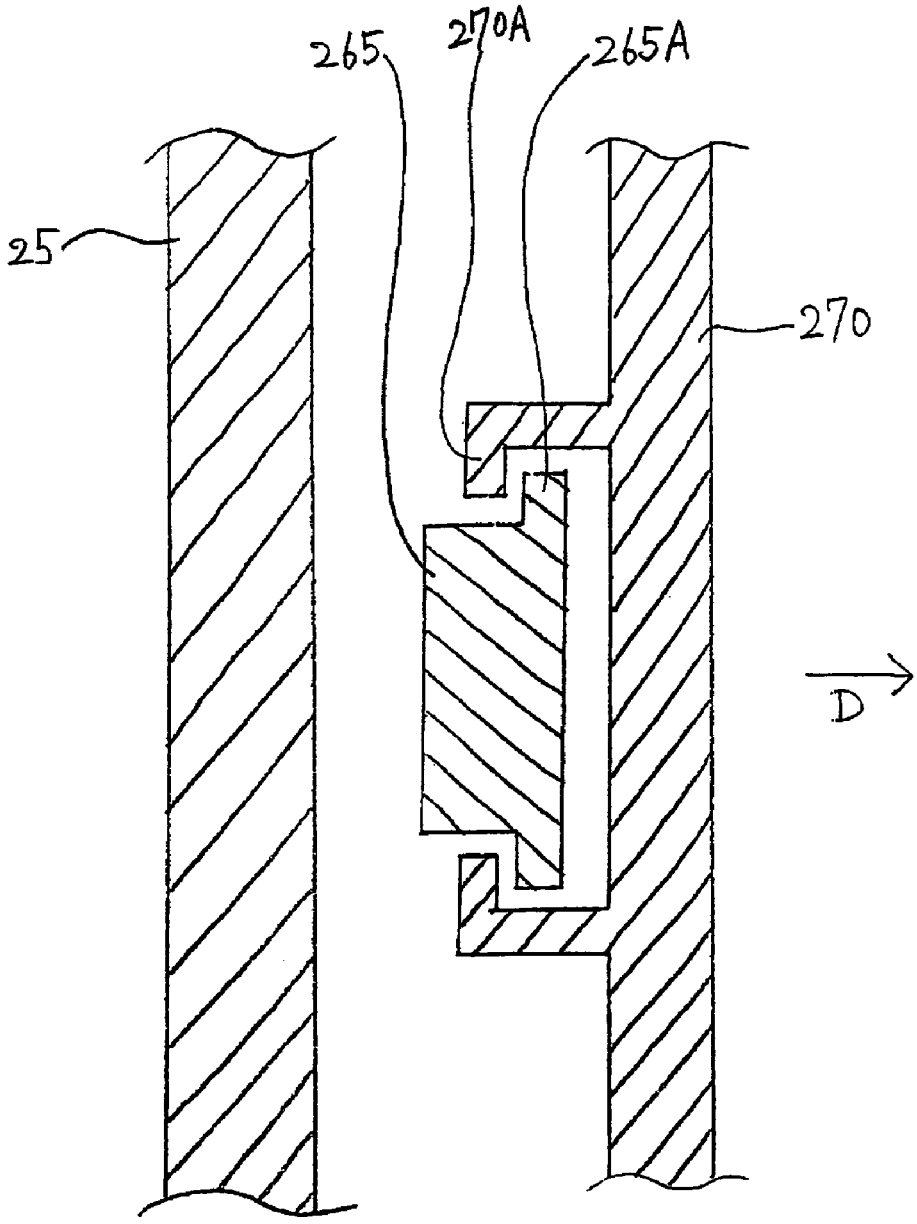
FIG. 25 is an explanatory cross-sectional view showing the construction of a transmission gear and a support member according to a modification.

(1) In the above-described illustrative aspects, lubricant such as grease is used, generating a viscous drag, which helps to remove the gears along with the support member 70. However, transmission gears and a support member may have such shapes that the transmission gears are pulled together with the support member when the support member is removed from the housing. For example, as shown in FIG. 25, a transmission gear 265 (input gear, idle gear, and/or agitator gear) has a flange 265A that protrudes radially outwardly. A support member 270 has an engaging part 270A which holds the flange 265A when the support member 270 is removed from the housing 25 in a direction D. In this construction, the transmission gear 265 is pulled together with the support member 270, as in the above-described illustrative aspects.

(2) In the illustrative aspects and additional aspects described above, a driving force is applied to the input gear 60. However, the driving force may be inputted to another gear such as the idle gear 68, for example. For example, a coupling member may be provided at the other gear in the axial direction thereof, thereby inputting the driving force to the other gear.

(3) In the illustrative aspects and additional aspects described above, the input gear 60, idle gear (intermediate gear) 68, and agitator gear 66 or 98 are removed together with the support member 70 or 90. However, all of the three gears need not be removed together with the support member 70 or 90. For example, only the input gear 60 may be removed together with the support member 70.

(4) In the illustrative aspects and additional aspects described above, neither the development gear 51 nor the supply gear 53 is removed together with the support member 70 or 90. However, the development gear 51 and/or the supply gear 53 may be removed together with the support member 70 or 90.

What is claimed is:

1. A developer cartridge comprising:

a casing;

a development roller rotatably disposed in the casing;

a support member provided as a separate member from the casing and mounted on the casing; and at least one transmission gear rotatably supported by the support member, the at least one transmission gear transmitting a driving force to the development roller, wherein:

the support member is configured to be dismounted from the casing together with the at least one transmission gear;

lubricant is applied between the support member and the at least one transmission gear; and when the support member is dismounted from the casing, viscous drag of the lubricant draws the at least one transmission gear toward the support member, thereby allowing the support member to be dismounted from the casing together with the at least one transmission gear.

2. The developer cartridge according to claim 1, wherein the at least one transmission gear comprises a plurality of gears.

3. The developer cartridge according to claim 2, wherein the plurality of gears includes:

an input gear that receives a driving force from outside the developer cartridge;

an agitator gear connected to a rotation shaft of an agitator that agitates developer; and an intermediate gear engaged with the input gear and the agitator gear.

4. The developer cartridge according to claim 1, wherein the development roller includes a rotation shaft;

wherein the casing includes a wall having an outer surface, the rotation shaft of the development roller being rotatably supported by the wall; and wherein the at least one transmission gear is disposed on the outer surface.

5. The developer cartridge according to claim 4, wherein the at least one transmission gear includes:

an input gear that receives a driving force from outside the developer cartridge;

an agitator gear connected to a rotation shaft of an agitator that agitates developer; and an intermediate gear engaged with the input gear and the agitator gear; and wherein the support member supports the input gear, the intermediate gear, and the agitator gear and is configured to be dismounted from the casing together with the input gear, the agitator gear, and the intermediate gear.

6. The developer cartridge according to claim 1, wherein the development roller includes a rotation shaft, further comprising a development gear connected to the rotation shaft of the development roller, the development gear being configured to be dismounted from the casing independently from the support member.

7. The developer cartridge according to claim 1, wherein the casing includes a wall having an outer surface;

wherein the support member is disposed in confrontation with the outer surface; and wherein the at least one transmission gear is disposed between the outer surface and the support member.

8. The developer cartridge according to claim 7, wherein the support member is formed with a screw hole and is configured to be fastened to the wall of the casing by driving a screw through the screw hole.

9. The developer cartridge according to claim 1, wherein the support member has a first support frame and a second support frame; and wherein the at least one transmission gear is disposed between the first support frame and the second support frame.

10. A developer cartridge comprising:

a casing;

a development roller rotatably disposed in the casing;

a support member provided as a separate member from the casing and mounted on the casing;

at least one transmission gear rotatably supported by the support member, the at least one transmission gear transmitting a driving force to the development roller;

a supply roller having a rotation shaft and supplying developer to the development roller; and a supply gear fixed to the rotation shaft of the supply roller and engaged with the at least one transmission gear, wherein:

the support member is configured to be dismounted from the casing together with the at least one transmission gear; and the supply gear is configured to be dismounted from the casing independently from the support member.

11. A developer cartridge comprising:

a casing that includes a wall having an outer surface;

a development roller rotatably disposed in the casing;

a support member provided as a separate member from the casing and mounted on the casing, the support member including:

a support member main frame; and a support boss protruding from the support member main frame and having a distal end; and at least one transmission gear rotatably supported by the support member, the at least one transmission gear transmitting a driving force to the development roller, wherein:

the at least one transmission gear is formed with a through-hole at its substantial center position;

the support boss being inserted in the through-hole of the at least one transmission gear, thereby rotatably supporting the at least one transmission gear;

the support boss has such a height that a distal end of the support boss abuts on the outer surface of the wall; and the support member is configured to be dismounted from the casing together with the at least one transmission gear.

12. The developer cartridge according to claim 11, further comprising an agitator rotatably disposed within the casing for agitating developer, the agitator having a rotation shaft, wherein the at least one transmission gear includes an agitator gear connected to the rotation shaft of the agitator;

wherein the support member has a receiving part that receives the agitator gear; and wherein a first contact area at which the agitator gear contacts the receiving part is larger than a second contact area at which the agitator gear contacts the rotation shaft of the agitator.

13. A developer cartridge comprising:

a casing;

a development roller rotatably disposed in the casing;

a support member provided as a separate member from the casing and mounted on the casing, the support member includes:

a first support frame; and a second support frame;

at least one transmission gear rotatably supported by the support member, the at least one transmission gear transmitting a driving force to the development roller; and a support boss that protrudes from either one of the first support frame and the second support frame toward the other support frame, wherein:

the support boss has a distal end;

the at least one transmission gear is formed with a through-hole at its substantial center position;

the support boss is inserted in the through-hole of the at least one transmission gear, thereby rotatably supporting the at least one transmission gear;

the support boss having such a height that the distal end abuts on the other support frame; and the support member is configured to be dismounted from the casing together with the at least one transmission.

14. The developer cartridge according to claim 13, wherein the support boss is formed with a screw hole in the distal end and is configured to be fastened to the other support frame by inserting a screw through the screw hole.

* * * * *